US012788194B2

(12) United States Patent
Ryu et al.

(10) Patent No.: US 12,788,194 B2
(45) Date of Patent: Nov. 10, 2026

(54) DUST COLLECTING DEVICE, CLEANER, AND CLEANER STATION

(71) Applicant: LG Electronics Inc., Seoul (KR)

(72) Inventors: Jungwan Ryu, Seoul (KR); Sungjun Kim, Seoul (KR); Donggeun Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 306 days.

(21) Appl. No.: 18/681,778

(22) PCT Filed: Aug. 5, 2022

(86) PCT No.: PCT/KR2022/011607

§ 371 (c)(1),
(2) Date: Feb. 6, 2024

(87) PCT Pub. No.: WO2023/014136

PCT Pub. Date: Feb. 9, 2023

(65) Prior Publication Data

US 2024/0374098 A1 Nov. 14, 2024

(30) Foreign Application Priority Data

Aug. 6, 2021 (KR) ..... 10-2021-0103987
Apr. 11, 2022 (KR) ..... 10-2022-0044644

(51) Int. Cl.
*A47L 9/16* (2006.01)
*A47L 9/00* (2006.01)
(Continued)

(52) U.S. Cl.
CPC ..... *A47L 9/1683* (2013.01); *A47L 9/0063* (2013.01); *A47L 9/009* (2013.01); *A47L 9/12* (2013.01);
(Continued)

(58) Field of Classification Search
CPC ..... A47L 9/1683; A47L 9/0063; A47L 9/009; A47L 9/12; A47L 9/149; A47L 9/1691; A47L 9/248; A47L 9/2884; A47L 9/325
See application file for complete search history.

(56) References Cited

U.S. PATENT DOCUMENTS

2020/0405107 A1* 12/2020 Na ..... A47L 9/2884
2021/0052121 A1* 2/2021 Kim ..... A47L 9/106

FOREIGN PATENT DOCUMENTS

CN 105877614 A 8/2016
DE 102004041021 B3 * 8/2005 ..... A47L 9/106
(Continued)

OTHER PUBLICATIONS

WO-2016165612-A1—English Machine Translation (Year: 2016).*
(Continued)

*Primary Examiner* — Marc Carlson
(74) *Attorney, Agent, or Firm* — Fish & Richardson P.C.

(57) ABSTRACT

The present disclosure relates to a dust collecting device including an air inflow part having a suction flow path through which air is introduced, a dust separating part configured to separate dust from the air introduced through the air inflow part, a dust bag configured to store the dust separated by the dust separating part, a bag support part configured to accommodate the dust bag, a housing configured to accommodate the bag support part and the dust separating part therein, a suction motor configured to provide a flow force of the air, and a connection part including a connection flow path configured to guide the air, which has passed through the dust separating part, to the suction motor, and a bypass flow path configured to connect the bag support part and the suction motor, thereby enabling a user to empty a dust bin only by removing the dust bag.

10 Claims, 24 Drawing Sheets

(51) Int. Cl.

| | |
|---|---|
| ***A47L 9/12*** | (2006.01) |
| ***A47L 9/14*** | (2006.01) |
| ***A47L 9/24*** | (2006.01) |
| ***A47L 9/28*** | (2006.01) |
| ***A47L 9/32*** | (2006.01) |

(52) U.S. Cl.

CPC ..... *A47L 9/149* (2013.01); *A47L 9/1691* (2013.01); *A47L 9/248* (2013.01); *A47L 9/2884* (2013.01); *A47L 9/325* (2013.01)

(56) References Cited

FOREIGN PATENT DOCUMENTS

| | | | | | |
|---|---|---|---|---|---|
| JP | 2008228768 | A | * | 10/2008 | |
| JP | 2015062556 | A | * | 4/2015 | |
| JP | 6698480 | B2 | * | 5/2020 | |
| JP | 2020185096 | A | * | 11/2020 | |
| KR | 10-2009-0025121 | A | | 3/2009 | |
| KR | 20090025121 | A | * | 3/2009 | ..... A47L 9/1683 |
| KR | 10-2014-0123169 | A | | 10/2014 | |
| KR | 20140123169 | A | * | 10/2014 | ..... A47L 9/248 |
| KR | 1993773 | B1 | | 6/2019 | |
| KR | 101993773 | B1 | * | 6/2019 | ..... B65F 1/06 |
| KR | 20200073966 | A | * | 6/2020 | ..... A47L 9/2873 |
| KR | 102161708 | B1 | * | 10/2020 | ..... A47L 9/00 |
| KR | 20210019940 | A | * | 2/2021 | ..... A47L 9/2836 |
| KR | 2240612 | B1 | | 4/2021 | |
| KR | 102240612 | B1 | * | 4/2021 | ..... B65F 1/062 |
| WO | WO-2016165612 | A1 | * | 10/2016 | ..... A47L 9/14 |

OTHER PUBLICATIONS

Partial European Search Report in European Appln. No. 22853511.8, mailed on Jul. 3, 2025, 16 pages.

Office Action in Australian Appln. No. 2022321358, mailed on Mar. 7, 2025, 7 pages.

Office Action in Korean Appln. No. 10-2022-0044644, mailed on Feb. 13, 2024, 28 pages (with English translation).

Extended European Search Report in European Appln. No. 22853511.8, mailed on Dec. 10, 2025, 16 pages.

Office Action in Chinese Appln. No. 202280055105.X, mailed on Jun. 11, 2026, 20 pages (with English translation).

* cited by examiner

DUST COLLECTING DEVICE, CLEANER, AND CLEANER STATION

CROSS-REFERENCE TO RELATED APPLICATIONS

This application is a National Stage application under 35 U.S.C. § 371 of International Application No. PCT/KR2022/011607, filed on Aug. 5, 2022, which claims the benefit of Korean Application Nos. 10-2022-0044644, filed on Apr. 11, 2022, and 10-2021-0103987, filed on Aug. 6, 2021. The disclosures of the prior applications are incorporated by reference in their entirety.

TECHNICAL FIELD

The present disclosure relates to a dust collecting device, a cleaner, and a cleaner station, and more particularly, to a dust collecting device, a cleaner, and a cleaner station, which are capable of separating dust contained in air, collecting the dust in a dust bag, and enabling a user to empty only the dust bag.

BACKGROUND ART

In general, a cleaner refers to an electrical appliance that draws in small garbage or dust by sucking air using electricity and fills a dust bin provided in a product with the garbage or dust. Such a cleaner is generally called a vacuum cleaner.

The cleaners may be classified into a manual cleaner which is moved directly by a user to perform a cleaning operation, and an automatic cleaner which performs a cleaning operation while autonomously traveling. Depending on the shape of the cleaner, the manual cleaners may be classified into a canister cleaner, an upright cleaner, a handy cleaner, a stick cleaner, and the like.

The canister cleaners were widely used in the past as household cleaners. However, recently, there is an increasing tendency to use the handy cleaner and the stick cleaner in which a dust bin and a cleaner main body are integrally provided to improve convenience of use.

In the case of the canister cleaner, a main body and a suction port are connected by a rubber hose or pipe, and in some instances, the canister cleaner may be used in a state in which a brush is fitted into the suction port.

The handy cleaner (hand vacuum cleaner) has maximized portability and is light in weight. However, because the handy cleaner has a short length, there may be a limitation to a cleaning region. Therefore, the handy cleaner is used to clean a local place such as a desk, a sofa, or an interior of a vehicle.

A user may use the stick cleaner while standing and thus may perform a cleaning operation without bending his/her waist. Therefore, the stick cleaner is advantageous for the user to clean a wide region while moving in the region. The handy cleaner may be used to clean a narrow space, whereas the stick cleaner may be used to clean a wide space and also used to a high place that the user's hand cannot reach. Recently, modularized stick cleaners are provided, such that types of cleaners are actively changed and used to clean various places.

In addition, recently, a robot cleaner, which autonomously performs a cleaning operation without a user's manipulation, is used. The robot cleaner automatically cleans a zone to be cleaned by sucking foreign substances such as dust from the floor while autonomously traveling in the zone to be cleaned.

However, because the handy cleaner, the stick cleaner, or the robot cleaner in the related art has a dust bin with a small capacity for storing collected dust, which inconveniences the user because the user needs to empty the dust bin frequently.

In addition, because the dust scatters during the process of emptying the dust bin, there is a problem in that the scattering dust has a harmful effect on the user's health.

In addition, if residual dust is not removed from the dust bin, there is a problem in that a suction force of the cleaner deteriorates.

In addition, if the residual dust is not removed from the dust bin, there is a problem in that the residual dust causes an offensive odor.

As a patent document in the related art, Korean Patent No. KR 10-2161708 B1 discloses a station including a dust bag.

Korean Patent No. KR 10-2161708 B1 discloses that a dust bin of a cleaner is coupled to the station, and a dust bag is disposed in the station. In this case, the dust bag is coupled in a housing of the cleaner along a sliding groove, and an outer surface of the dust bag is made of a material that may filter the air while transmitting the air.

However, in case that a permeable or semi-permeable dust bag is used, there is a problem in that dust in the dust bag may leak to the outside from the dust bag, and offensive odor may also leak to the outside from the dust bag.

In addition, as a patent document in the related art, Korean Patent Application Laid-Open No. KR 10-2021-0019940 A discloses a cleaner station configured to capture dust collected in a dust bin of a cleaner.

Korean Patent Application Laid-Open No. KR 10-2021-0019940 A discloses that the cleaner sucks dust contained in the air and stores the dust, the cleaner station is coupled to the dust bin to remove dust stored in the dust bin, and the cleaner station includes a dust collecting motor configured to suck debris and internal air in the dust bin coupled to the cleaner station, and a vinyl bag type dust collecting part.

However, in the case of the cleaner station, when the dust collecting motor operates, the vinyl bag may be pulled toward the dust collecting motor and squashed flat.

Therefore, when the dust collecting motor of the cleaner station operates, an internal space of the vinyl bag is narrowed, which makes it difficult to capture the dust in the vinyl bag.

In addition, in the case of the cleaner station, the air from which dust is not separated is captured in the vinyl bag, which causes a problem in that a part of the dust is introduced into the dust collecting motor.

DISCLOSURE

Technical Problem

The present disclosure has been made in an effort to solve the above-mentioned problems with the dust collecting device, the cleaner, and the cleaner station in the related art, and an object of the present disclosure is to provide a dust collecting device, a cleaner, and a cleaner station, which are capable of maintaining a shape of a dust bag while the dust is collected.

The present disclosure has also been made in an effort to provide a dust collecting device, a cleaner, and a cleaner station, in which dust may be separated from the air during a process in which the air containing the dust flows toward a dust collecting motor, and the dust may be captured in the dust bag.

The present disclosure has also been made in an effort to provide a dust collecting device, a cleaner, and a cleaner station that do not require a user to manually tie a dust bag.

The present disclosure has also been made in an effort to provide a dust collecting device, a cleaner, and a cleaner station that enable a user to empty a dust bin only by removing a dust bag.

Technical Solution

In order to achieve the above-mentioned objects, the present disclosure provides a dust collecting device including: an air inflow part having a suction flow path through which air is introduced; a dust separating part configured to separate dust from the air introduced through the air inflow part; a dust bag configured to store the dust separated by the dust separating part; a bag support part configured to accommodate the dust bag; a housing configured to accommodate the bag support part and the dust separating part therein; a suction motor configured to provide a flow force of the air; and a connection part including a connection flow path configured to guide the air, which has passed through the dust separating part, to the suction motor, and a bypass flow path configured to connect the bag support part and the suction motor.

The bag support part may include: a support part main body configured to accommodate the dust bag therein; and a plurality of suction holes formed along an outer peripheral surface of the support part main body.

The bag support part may include: a support part main body configured to accommodate the dust bag therein; and a plurality of suction holes formed in a lower surface of the support part main body based on the gravitational direction.

The housing may include: a lower housing coupled to the bag support part and connected to the bypass flow path; and an upper housing connected to the air inflow part, configured to accommodate the dust separating part, and connected to the connection flow path.

The connection flow path and the bypass flow path of the connection part may communicate with each other.

The dust bag may be made of an impermeable material.

The dust bag may expand in the bag support part when the suction motor operates.

A space may be defined between an outer peripheral surface of the support part main body and an inner peripheral surface of the lower housing.

A space may be defined between a lower surface of the support part main body and a lower surface of the lower housing.

In order to achieve the above-mentioned objects, the present disclosure provides a cleaner including: a suction part having a suction flow path through which air is introduced; a dust separating part configured to separate dust from the air introduced through the air inflow part; a dust bag configured to store the dust separated by the dust separating part; a bag support part configured to accommodate the dust bag; a housing configured to accommodate the bag support part and the dust separating part therein; a suction motor configured to provide a flow force of the air; a battery configured to supply power to the suction motor; a handle configured to be gripped by a user; and a connection part including a connection flow path configured to guide the air, which has passed through the dust separating part, to the suction motor, and a bypass flow path configured to guide the air, which has passed through a space between the bag support part and the housing, to the suction motor.

In order to achieve the above-mentioned objects, the present disclosure provides a cleaner station including: a housing; a coupling part disposed in the housing and including a coupling surface to which at least a part of a cleaner is coupled; a dust collecting part accommodated in the housing, disposed at a lower side of the coupling part, and configured to capture dust in a dust bin of the cleaner; a dust collecting motor accommodated in the housing, disposed below the dust collecting part, and configured to generate a suction force for sucking dust in the dust bin; and a flow path part including a first flow path configured to connect the dust bin of the cleaner and the dust collecting part, and a second flow path configured to guide air, which has passed through the dust collecting part, to the dust collecting motor.

In this case, the dust collecting part may include: a dust separating part configured to separate dust from the air introduced from the dust bin; a dust bag configured to store the dust separated by the dust separating part; and a bag support part configured to accommodate the dust bag.

The flow path part may further include a bypass flow path configured to connect the bag support part and the dust collecting motor.

The dust collecting part may further include a dust bag cartridge separably coupled to the housing and configured to supply the dust bag.

The dust collecting part may further include a prefilter disposed in the second flow path and configured to separate debris from air flowing along the second flow path.

The dust collecting part may further include a joining device configured to join the dust bag.

The joining device may operate in a state in which an operation of the dust collecting motor is ended.

The bag support part may include: a support part main body configured to accommodate the dust bag therein; and a wheel provided on a lower surface of the support part main body.

The cleaner station according to the present disclosure may further include: a bag accommodation space formed in the housing and configured to accommodate the bag support part, in which the dust bag is accommodated in the bag support part and discharged from the bag accommodation space.

The first flow path may be connected to an upper side of the bag accommodation space, and the second flow path may be connected to an upper side of the bag accommodation space.

The bypass flow path may be connected to a lower side of the bag accommodation space.

Advantageous Effects

According to the dust collecting device, the cleaner, and the cleaner station according to the present disclosure described above, it is possible to maintain the shape of the dust bag during the process of collecting dust.

In addition, during the process in which the air containing dust flows toward the dust collecting motor, the dust may be separated and captured in the dust bag.

In addition, because the upper side of the dust bag is joined by the joining device, the user may seal the dust bag without manually tying the dust bag.

In addition, the user may empty the dust bin only by removing the sealed dust bag.

MODE FOR INVENTION

Figure 1:
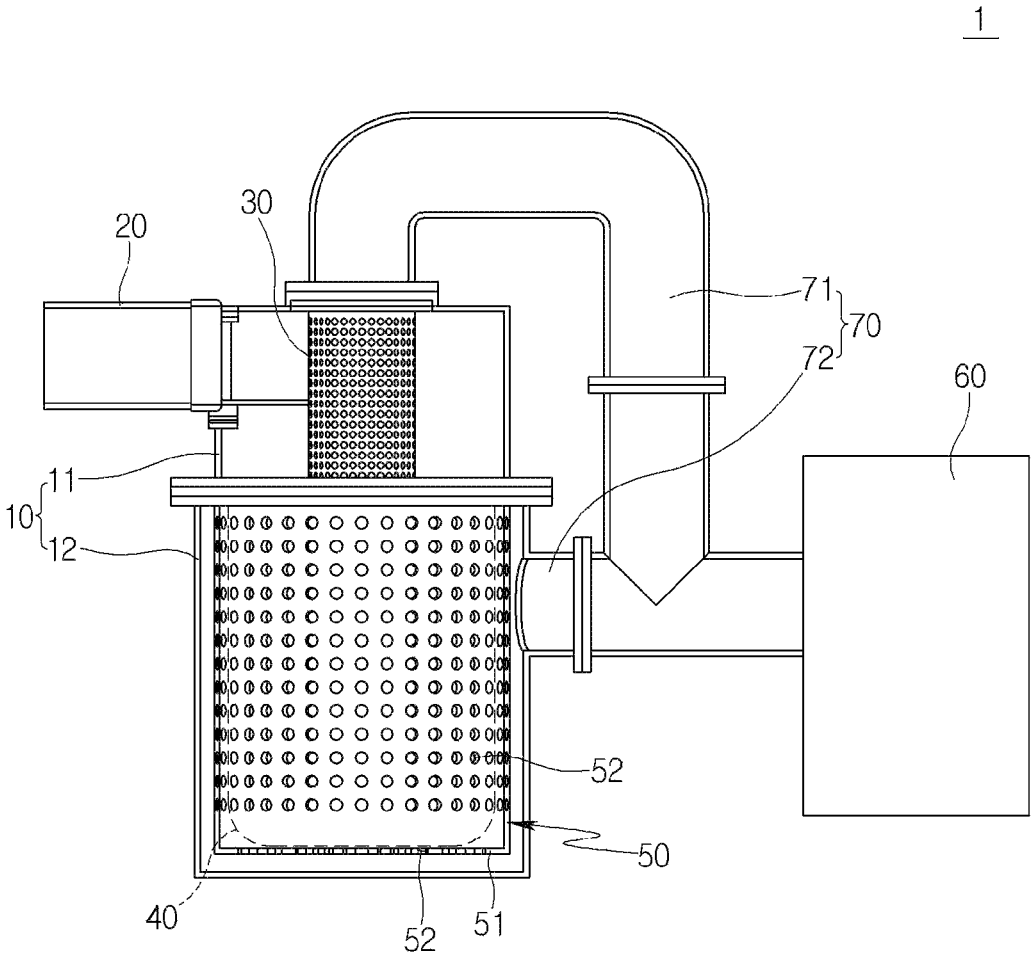
FIG. 1 is a view for explaining a dust collecting device according to an embodiment of the present disclosure.

Hereinafter, exemplary embodiments of the present disclosure will be described in detail with reference to the accompanying drawings.

The present disclosure may be variously modified and may have various embodiments, and particular embodiments illustrated in the drawings will be specifically described below. The description of the embodiments is not intended to limit the present disclosure to the particular embodiments, but it should be interpreted that the present disclosure is to cover all modifications, equivalents and alternatives falling within the spirit and technical scope of the present disclosure.

The terminology used herein is used for the purpose of describing particular embodiments only and is not intended to limit the present disclosure. Singular expressions may include plural expressions unless clearly described as different meanings in the context.

Unless otherwise defined, all terms used herein, including technical or scientific terms, may have the same meaning as commonly understood by those skilled in the art to which the present disclosure pertains. The terms such as those defined in a commonly used dictionary may be interpreted as having meanings consistent with meanings in the context of related technologies and may not be interpreted as ideal or excessively formal meanings unless explicitly defined in the present application.

Dust Collecting Device

FIG. 1 is a view for explaining a dust collecting device according to an embodiment of the present disclosure.

A dust collecting device 1 according to an embodiment of the present disclosure will be described with reference to FIG. 1.

The dust collecting device 1 includes a housing 10, an air inflow part 20, a dust separating part 30, a dust bag 40, a bag support part 50, a suction motor 60, and a connection part 70.

The housing 10 may define an external appearance of the dust collecting device 1. The housing 10 may provide a space capable of accommodating the dust separating part 30, the dust bag 40, and the bag support part 50 therein. The housing 10 may be formed in a shape similar to a cylindrical shape.

The housing 10 may include a lower housing 11 and an upper housing 12.

The bag support part 50 may be coupled to the lower housing 11, and the connection part 70 may be connected to the lower housing 11. Specifically, the bag support part 50 may be coupled in the lower housing 11. At least a part of the dust bag 40 may be accommodated in the lower housing 11 when the suction motor 60 operates. A bypass flow path 72 of the connection part 70 may be connected to the lower housing 11. In this case, a space (hereinafter, also referred to as a 'lateral space') with a predetermined interval may be defined between an inner peripheral surface of the lower housing 11 and an outer peripheral surface of the bag support part 50, and the air may flow through the space. In addition, a space (hereinafter, also referred to as a 'lower space') with a predetermined interval may be defined between a lower surface of the lower housing 11 and a lower surface of the bag support part 50, and the air may flow through the space. Further, the lateral space and the lower space may communicate with the bypass flow path 72.

The upper housing 12 may be connected to the air inflow part 20, accommodate the dust separating part 30, and be connected to the connection part 70. Specifically, the air inflow part 20 may be connected to one side of the upper housing 12, and the dust separating part 30 may be coupled in the upper housing 12. A connection flow path 71 of the connection part 70 may be connected to the upper housing 12.

The air inflow part 20 may protrude outward from the housing 10. Specifically, the air inflow part 20 may protrude outward from the upper housing 10. For example, the air inflow part 20 may be formed in a cylindrical shape with an opened inside. The air inflow part 20 may provide a flow path (hereinafter, also referred to as a 'suction flow path') through which air containing dust may flow. The suction flow path may communicate with the space in the housing 10.

The dust separating part 30 may communicate with the air inflow part 20. The dust separating part 30 may separate dust introduced into the dust separating part 30 through the air inflow part 20. A space in the dust separating part 30 may communicate with a space in the bag support part 50.

For example, the dust separating part 30 may have one or more cyclone parts capable of separating dust by using a cyclone flow. Further, the space in the dust separating part 30 may communicate with the suction flow path. Therefore, air and dust, which are sucked through the air inflow part 20, spirally flow along an inner circumferential surface of the dust separating part 30. Therefore, the cyclone flow may be generated in an internal space of the dust separating part 30.

The dust separating part 30 communicates with the air inflow part 20. The dust separating part 30 adopts a principle of a dust collector using a centrifugal force to separate the dust sucked into the housing 10 through the air inflow part 20.

The dust separating part 30 may further include a secondary cyclone part configured to separate again dust from the air discharged from the cyclone part. In this case, the secondary cyclone part may be positioned in the cyclone part to minimize a size of the dust separating part. The secondary cyclone part may include a plurality of cyclone bodies disposed in parallel. The air discharged from the cyclone part may be distributed to and pass through the plurality of cyclone bodies.

The dust bag 40 may be disposed in the lower housing 11. The dust bag 40 may be disposed below the dust separating part 30 based on the gravitational direction.

The dust bag 40 may be made of an impermeable material. For example, the dust bag 40 may include a roll vinyl film (not illustrated). The dust bag 40 may be fixed to the housing 10 and configured to be spread by a negative pressure generated when the suction motor 60 operates. With this configuration, the dust bag 40 is sealed or joined, which may prevent dust or offensive odor captured in the dust bag 40 from leaking to the outside from the dust bag 40.

In this case, the dust bag 40 in the spread state may be accommodated in the bag support part 50. That is, the dust bag may expand in the bag support part 50 when the suction motor 60 operates. Further, the dust bag 40 in the spread state is supported by the bag support part 50, such that a shape of the dust bag 40 may be maintained.

The dust bag 40 may store the dust separated by the dust separating part 30. An upper region of the dust bag 40 may be cut and joined by a joining device (not illustrated). In the state in which the upper region of the dust bag 40 is cut and joined, the dust bag 40 may be separated from the bag support part 50.

With this configuration, a user need not separately tie a bag in which dust is captured, such that the user convenience may be improved.

The bag support part 50 may support the dust bag 40. In case that the dust bag 40 expands, the bag support part 50 may accommodate the dust bag 40 therein. The bag support part 50 may support an external shape of the expanded dust bag 40.

Specifically, the bag support part 50 may include a support part main body 51 and suction holes 52.

The support part main body 51 may be coupled in the lower housing 11. For example, the support part main body 51 may be formed in a cylindrical shape, and an upper end of the support part main body 51 may be fitted with and coupled to the lower housing 11. In addition, a space may be defined between an outer peripheral surface of the support part main body 51 and the inner peripheral surface of the lower housing 11. Further, a space may be defined between a lower surface of the support part main body 51 and the lower surface of the lower housing 11. The space may provide a route along which a suction force of the suction motor 60 is transmitted.

With this configuration, when the suction motor 60 operates, the air, which is present in the space between the support part main body 51 and the lower housing 11, may be sucked into the suction motor 60 by a suction force of the suction motor 60, and a negative pressure, which expands the dust bag 40, may be generated in the space between the support part main body 51 and the lower housing 11.

The support part main body 51 may be formed to accommodate the dust bag 40 in case that the dust bag 40 expands. For example, the support part main body 51 may be formed in a cylindrical shape, an upper side of the support part main body 51 may be opened, and at least a part of a lower side of the support part main body 51 may be closed. In this case, at least a part of the dust bag 40 may be disposed at an upper side of the support part main body 51. Further, in case that the dust bag 40 expands, the dust bag 40 may expand downward and fill an internal space of the support part main body 51.

The suction holes 52 may be provided as a plurality of suction holes 52 formed in the support part main body 51. For example, the plurality of suction holes 52 may be formed at predetermined intervals along the outer peripheral surface of the support part main body 51. Further, one or more suction holes 52 may be formed in the lower surface of the support part main body 51. With this configuration, when the suction motor 60 operates, the air in the support part main body 51 may flow to the outside of the support part main body 51 through the suction holes 52. In addition, in the state in which the dust bag 40 is expanded in the support part main body 51, the negative pressure may be applied to the dust bag 40 toward the outside of the support part main body 51, and the dust bag 40 may expand to come into close contact with the inner peripheral surface and the lower surface of the support part main body 51. That is, the dust bag 40 may expand along an internal shape of the bag support part 50.

The suction motor 60 may generate a flow force that allows the air to flow. The suction motor 60 may be connected to the housing 10 through the connection part 70. The suction motor 60 may generate the suction force while rotating.

The connection part 70 may connect the housing 10 and the suction motor 60. The connection part 70 may provide a flow path through which the air in the housing 10 may flow to the suction motor 60.

Specifically, the connection part 70 may include the connection flow path 71 and the bypass flow path 72. The connection flow path 71 may connect the upper housing 12 and the suction motor 60. For example, the connection flow path 71 may be formed in a tubular shape. One end of the connection flow path 71 may be connected to the upper housing 12, and the other end of the connection flow path 71 may be connected to a housing of the suction motor 60.

The connection flow path 71 may communicate with an internal space of the upper housing 12 and an internal space of the housing of the suction motor 60. Further, the connection flow path 71 may communicate with the internal space of the dust separating part 30 coupled to the upper housing 12. With this configuration, the connection flow path 71 may guide the air, which has passed through the dust separating part 30, to the suction motor 60.

The bypass flow path 72 may communicate with an internal space of the lower housing 11 and the internal space of the housing of the suction motor 60. In this case, the bypass flow path 72 may communicate with the space (the lower space) defined between the lower surface of the lower housing 11 and the lower surface of the bag support part 50. With this configuration, the bypass flow path 72 may guide the air, which is present in the space between the bag support part 50 and the lower housing 11, to the suction motor 60.

The connection flow path 71 and the bypass flow path 72 may communicate with each other and be connected to the housing of the suction motor 60. For example, the connection flow path 71 may be connected to the bypass flow path 72, and the bypass flow path 72 may be connected to the housing of the suction motor 60. As another example, the bypass flow path 72 may be connected to the connection flow path 71, and the connection flow path 71 may be connected to the housing of the suction motor 60. Therefore, the connection flow path 71 and the bypass flow path 72 may be respectively connected to the housing 10 and the suction motor 60 by means of the flow paths.

With this configuration, the operation of the suction motor 60 may simultaneously maintain the shape of the dust bag and suck outside air.

According to the present disclosure, the dust collecting device 1 may further include a dust bag cartridge (not illustrated). The dust bag cartridge (not illustrated) may be separably coupled to the housing 10 and supply the dust bag 40.

The dust bag cartridge (not illustrated) may be detachably coupled to the housing 10. Although not illustrated, a structure to which the dust bag cartridge (not illustrated) is coupled may be provided in the housing 10, and the user may insert the dust bag cartridge (not illustrated) into the housing 10. In addition, the dust bag cartridge (not illustrated) may be separated from the housing 10 when the user pulls the dust bag cartridge (not illustrated) in the state in which the dust bag cartridge (not illustrated) is coupled to the housing 10. With this configuration, the user may easily mount or separate the dust bag cartridge (not illustrated) in or from the housing.

The dust bag 40 may be provided in the dust bag cartridge (not illustrated). For example, at least a part of the dust bag 40, which is provided in the form of a roll vinyl film, may be coupled to the dust bag cartridge (not illustrated). The dust bag 40 may be expanded in the direction toward the bag support part 50 by the operation of the suction motor 60. In addition, when the joining device (not illustrated) to be described below operates, the dust bag 40 may be joined, and a part of the dust bag 40 may be separated from the dust bag cartridge (not illustrated). With this configuration, the user need not separately tie a bag in which dust is captured, such that the user convenience may be improved.

The dust collecting device 1 according to the present disclosure may further include the joining device (not illustrated). The joining device (not illustrated) may join the dust bag 40.

The joining device (not illustrated) may be disposed in the housing 10. The joining device (not illustrated) may be disposed in an upper region of the bag support part 50. The joining device (not illustrated) may cut and join the upper region of the roll vinyl film in which the dust is captured. Specifically, the joining device (not illustrated) may retract the roll vinyl film to a central region and join the upper region of the roll vinyl film by using a heating wire. For example, the joining device (not illustrated) may include a first joining member (not illustrated) and a second joining member (not illustrated). The first joining member (not illustrated) may be moved in a first direction by a first joining drive part, and the second joining member (not illustrated) may be moved in a second direction perpendicular to the first direction by a second joining drive part.

With this configuration, the dust captured from the outside may be collected in the roll vinyl film, and the roll vinyl film may be automatically joined. Therefore, it is not necessary for the user to separately tie a bag in which the dust is captured, and as a result, it is possible to improve convenience for the user.

Cleaner

Figure 2:
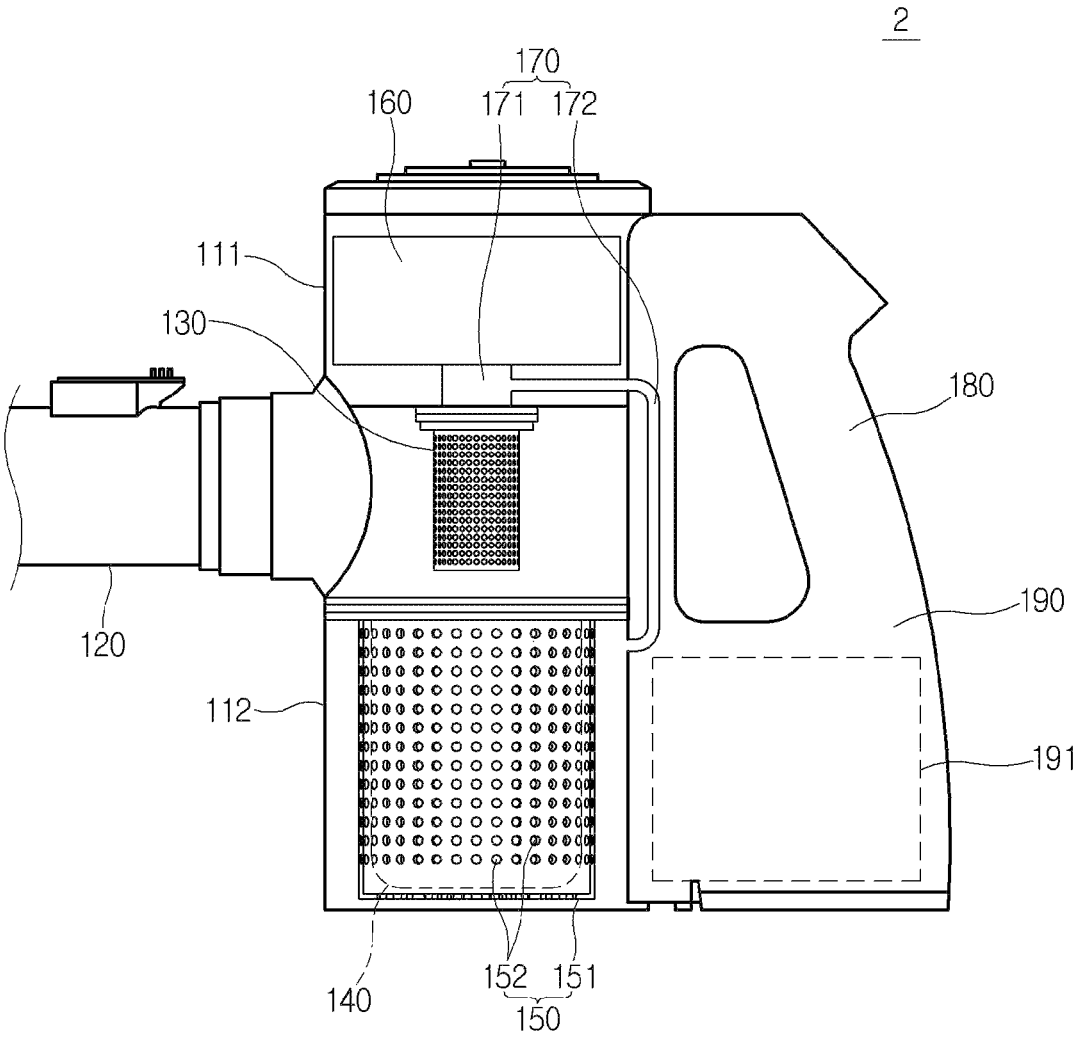
FIG. 2 is a schematic view of a configuration of a cleaner according to the embodiment of the present disclosure.

FIG. 2 is a schematic view of a configuration of a cleaner according to the embodiment of the present disclosure.

A structure of a cleaner 2 according to the present disclosure will be described with reference to FIG. 2.

The cleaner 2 may mean a cleaner configured to be manually operated by the user. For example, the cleaner 2 may mean a handy cleaner or a stick cleaner.

Meanwhile, in the embodiment of the present disclosure, directions may be defined on the basis of when a bottom surface (lower surface) of a housing 110 and a bottom surface (lower surface) of a battery housing 190 are placed on the ground surface.

In this case, a forward direction may mean a direction in which a suction part 120 is disposed based on the housing 110, and a rearward direction may mean a direction in which a handle 180 is disposed. Further, based on a state in which the suction part 120 is viewed from the suction motor 160, a rightward direction may refer to a direction in which a component is disposed at the right, and a left direction may refer to a direction in which a component is disposed at the left. In addition, in the embodiment of the present disclosure, upper and lower sides may be defined in a direction perpendicular to the ground surface based on the state in which the bottom surface (lower surface) of the housing 110 and the bottom surface (lower surface) of the battery housing 190 are placed on the ground surface.

The cleaner 2 may include the housing 110, the suction part 120, a dust separating part 130, a dust bag 140, a bag support part 150, the suction motor 160, a connection part 170, the handle 180, and the battery housing 190.

The housing 110 may define an external appearance of the cleaner 2. The housing 110 may provide a space capable of accommodating the dust separating part 130, the dust bag 140, and the bag support part 150 therein. The housing 110 may be formed in a shape similar to a cylindrical shape.

The housing 110 may include a lower housing 111 and an upper housing 112.

The bag support part 150 may be coupled to the lower housing 111, and the connection part 170 may be connected to the lower housing 111. Specifically, the bag support part 150 may be coupled in the lower housing 111. At least a part of the dust bag 140 may be accommodated in the lower housing 111 when the suction motor 160 operates. A bypass flow path 172 of the connection part 170 may be connected to the lower housing 111. In this case, a space (hereinafter, also referred to as a 'lateral space') with a predetermined interval may be defined between an inner peripheral surface of the lower housing 111 and an outer peripheral surface of the bag support part 150, and the air may flow through the lateral space. In addition, a space (hereinafter, also referred to as a 'lower space') with a predetermined interval may be defined between a lower surface of the lower housing 111 and a lower surface of the bag support part 150, and the air may flow through the lower space. Further, the lateral space and the lower space may communicate with the bypass flow path 172.

The upper housing 112 may be connected to the suction part 120, accommodate the dust separating part 130, and be connected to the connection part 170. Specifically, the suction part 120 may be connected to one side of the upper housing 112, and the dust separating part 130 may be coupled in the upper housing 112. A connection flow path 171 of the connection part 170 may be connected to the upper housing 112.

The suction part 120 may protrude outward from the housing 110. For example, the suction part 120 may be formed in a cylindrical shape with an opened inside. The suction part 120 may be coupled to the extension tube (not illustrated). The suction part 120 may provide a flow path (hereinafter, referred to as a 'suction flow path') through which air containing dust may flow.

The dust separating part 130 may communicate with the suction part 120. The dust separating part 130 may separate dust sucked into the dust separating part 130 through the suction part 120. A space in the dust separating part 130 may communicate with a space in the housing 110.

For example, the dust separating part 130 may have one or more cyclone parts capable of separating dust by using a cyclone flow. Further, the space in the dust separating part 130 may communicate with the suction flow path. Therefore, air and dust, which are sucked through the suction part 120, spirally flow along an inner circumferential surface of the dust separating part 130. Therefore, the cyclone flow may be generated in the internal space of the dust separating part 130.

The dust separating part 130 communicates with the suction part 120. The dust separating part 130 adopts a principle of a dust collector using a centrifugal force to separate the dust sucked into the housing 110 through the suction part 120.

The dust separating part 130 may further include a secondary cyclone part configured to separate again dust from the air discharged from the cyclone part. In this case, the secondary cyclone part may be positioned in the cyclone part to minimize a size of the dust separating part 130.

The dust bag 140 may be disposed in the lower housing 111. The dust bag 140 may be disposed below the dust separating part 130 based on the gravitational direction.

The dust bag 140 may be made of an impermeable material. For example, the dust bag 140 may include a roll vinyl film (not illustrated). The dust bag 140 may be fixed to the housing 110 and configured to be spread by a suction force (negative pressure) generated when the suction motor 160 operates. With this configuration, the dust bag 140 is sealed or joined, which may prevent dust or offensive odor captured in the dust bag 140 from leaking to the outside from the dust bag 140.

In this case, the dust bag 140 in the spread state may be accommodated in the bag support part 150. That is, the dust bag 140 may expand in the bag support part 150 when the suction motor 160 operates. Further, the dust bag 140 in the spread state is supported by the bag support part 150, such that a shape of the dust bag 140 may be maintained.

The dust bag 140 may store the dust separated by the dust separating part 130.

With this configuration, the user need not separately tie a bag in which dust is captured, such that the user convenience may be improved.

The bag support part 150 may support the dust bag 140. In case that the dust bag 140 expands, the bag support part 150 may accommodate the dust bag 140 therein. The bag support part 150 may support an external shape of the expanded dust bag 140.

Specifically, the bag support part 150 may include a support part main body 151 and suction holes 152.

The support part main body 151 may be coupled in the lower housing 111. The support part main body 151 may be coupled in the lower housing 111. For example, the support part main body 151 may be formed in a cylindrical shape, and an upper end of the support part main body 151 may be fitted with and coupled to the lower housing 111. In addition, a space may be defined between an outer peripheral surface of the support part main body 151 and the inner peripheral surface of the lower housing 111. Further, a space may be defined between a lower surface of the support part main body 151 and the lower surface of the lower housing 111. The space may provide a route along which a suction force of the suction motor 160 is transmitted.

With this configuration, when the suction motor 160 operates, the air, which is present in the space between the support part main body 151 and the lower housing 111, may be sucked into the suction motor 160 by a suction force of the suction motor 160. A suction force (negative pressure) for expanding the dust bag 140 in the direction toward the lower surface (bottom surface) of the support part main body 151 may be applied to the space between the support part main body 151 and the lower housing 111.

The support part main body 151 may be formed to accommodate the dust bag 140 in case that the dust bag 140 expands. For example, the support part main body 151 may be formed in a cylindrical shape, an upper side of the support part main body 151 may be opened, and at least a part of a lower side of the support part main body 151 may be closed. In this case, at least a part of the dust bag 140 may be disposed at an upper side of the support part main body 151. Further, in case that the dust bag 140 expands, the dust bag 140 may expand toward the lower surface (bottom surface) of the support part main body 151 and fill an internal space of the support part main body 151.

The suction holes 152 may be provided as a plurality of suction holes 152 formed in the support part main body 151. For example, the plurality of suction holes 152 may be formed along the outer peripheral surface of the support part main body 151. Further, one or more suction holes 152 may be formed in the lower surface of the support part main body 151. With this configuration, when the suction motor 160 operates, the air in the support part main body 151 may flow to the outside of the support part main body 151 through the suction holes 152. In addition, in the state in which the dust bag 140 is expanded in the support part main body 151, the negative pressure may be applied to the dust bag 140 toward the outside of the support part main body 151, and the dust bag 140 may expand to come into close contact with the inner peripheral surface and the lower surface of the support part main body 151. That is, the dust bag 140 may expand along an internal shape of the bag support part 150.

The suction motor 160 may generate a suction force for sucking air. The suction motor 160 may be connected to the connection part 170 by means of the flow path, the air may be introduced through the connection part 170.

The suction motor 160 may be accommodated in a motor housing (not illustrated). In this case, the motor housing (not illustrated) may be integrated with the housing 110. The motor housing (not illustrated) may be provided separately from the housing 110. The motor housing (not illustrated) may be connected to the connection part 170. An internal space of the motor housing (not illustrated) may communicate with the connection part 170. For example, the internal space of the motor housing (not illustrated) may communicate with the connection flow path 171. As another example, the internal space of the motor housing (not illustrated) may communicate with the bypass flow path 172.

A filter (not illustrated) may be accommodated in the motor housing (not illustrated). With this configuration, the filter may filter out debris from the air introduced into the suction motor 160.

An air discharge hole may be formed in the motor housing (not illustrated). With this configuration, the air introduced into the suction motor 160 may be discharged.

The connection part 170 may connect the housing 110 and the suction motor 160. The connection part 170 may provide a flow path through which the air in the housing 110 may flow to the suction motor 160.

Specifically, the connection part 170 may include the connection flow path 171 and the bypass flow path 172. The connection flow path 171 may connect the upper housing 112 and the suction motor 160. For example, the connection flow path 171 may be formed in a tubular shape. One end of the connection flow path 171 may be connected to the upper housing 112, and the other end of the connection flow path 171 may be connected to the motor housing of the suction motor 160.

The connection flow path 171 may communicate with an internal space of the upper housing 112 and an internal space of the motor housing of the suction motor 160. Further, the connection flow path 171 may communicate with the internal space of the dust separating part 130 coupled to the upper housing 112. With this configuration, the connection flow path 171 may guide the air, which has passed through the dust separating part 130, to the suction motor 160.

The bypass flow path 172 may communicate with an internal space of the lower housing 111 and the internal space of the motor housing of the suction motor 160. In this case, the bypass flow path 172 may communicate with the space (the lower space) defined between the lower surface of the lower housing 111 and the lower surface of the bag support part 150. With this configuration, the bypass flow path 172 may guide the air, which is present in the space between the bag support part 150 and the lower housing 111, to the suction motor 160.

The connection flow path 171 and the bypass flow path 172 may communicate with each other and be connected to the motor housing of the suction motor 160. For example, the connection flow path 171 may be connected to the bypass flow path 172, and the bypass flow path 172 may be connected to the motor housing of the suction motor 160. As another example, the bypass flow path 172 may be connected to the connection flow path 171, and the connection flow path 171 may be connected to the motor housing of the suction motor 160. Therefore, the connection flow path 171 and the bypass flow path 172 may be respectively connected to the housing 110 and the suction motor 160 by means of the flow paths.

With this configuration, the operation of the suction motor 160 may simultaneously maintain the shape of the dust bag and suck outside air.

The handle 180 may be gripped by the user. The handle 180 may be disposed rearward of the suction motor 160. For example, the handle 180 may be formed in a shape similar to a cylindrical shape. Alternatively, the handle 180 may be formed in a curved cylindrical shape.

The handle 180 may include a grip portion formed in a column shape so that the user may grip the grip portion, and an extension portion connected to the grip portion and extending toward the housing 110.

The cleaner 2 may include the battery housing 190. A battery 191 may be accommodated in the battery housing 190. The battery housing 190 may be disposed below the handle 180. For example, the battery housing 190 may have a hexahedral shape opened at a lower side thereof. A rear side of the battery housing 190 may be connected to the handle 180.

The battery housing 190 may include an accommodation portion opened downward. The battery 191 may be attached or detached through the accommodation portion of the battery housing 190.

The cleaner 2 may include the battery 191.

For example, the battery 191 may be separably coupled to the cleaner 2. The battery 191 may be separably coupled to the battery housing 190. For example, the battery 191 may be inserted into the battery housing 190 from the lower side of the battery housing 190. With this configuration, the portability of the cleaner 2 may be improved.

On the contrary, the battery 191 may be integrally provided in the battery housing 190. In this case, a lower surface of the battery 191 is not exposed to the outside.

The battery 191 may supply power to the suction motor 160 of the cleaner 2. The battery 191 may be disposed below the handle 180. The battery 191 may be disposed rearward of the housing 110.

The cleaner 2 according to the present disclosure may further include the dust bag cartridge (not illustrated). The dust bag cartridge (not illustrated) may be separably coupled to the housing 110 and supply the dust bag 140.

The dust bag cartridge (not illustrated) may be detachably coupled to the housing 110. Although not illustrated, a structure to which the dust bag cartridge (not illustrated) is coupled may be provided in the housing 110, and the user may insert the dust bag cartridge (not illustrated) into the housing 110. In addition, the dust bag cartridge (not illustrated) may be separated from the housing 110 when the user pulls the dust bag cartridge (not illustrated) in the state in which the dust bag cartridge (not illustrated) is coupled to the housing 110. With this configuration, the user may easily mount or separate the dust bag cartridge (not illustrated) in or from the housing.

The dust bag 140 may be provided in the dust bag cartridge (not illustrated). For example, at least a part of the dust bag 140, which is provided in the form of a roll vinyl film, may be coupled to the dust bag cartridge (not illustrated). The dust bag 140 may be expanded in the direction toward the bag support part 150 by the operation of the suction motor 160. In addition, when the joining device (not illustrated) to be described below operates, the dust bag 140 may be joined, and a part of the dust bag 140 may be separated from the dust bag cartridge (not illustrated). With this configuration, the user need not separately tie a bag in which dust is captured, such that the user convenience may be improved.

The cleaner 2 according to the present disclosure may further include the joining device (not illustrated). The joining device (not illustrated) may join the dust bag 140.

The joining device (not illustrated) may be disposed in the housing 110. The joining device (not illustrated) may be disposed in an upper region of the bag support part 150. The joining device (not illustrated) may cut and join the upper region of the roll vinyl film in which the dust is captured. Specifically, the joining device (not illustrated) may retract the roll vinyl film to a central region and join the upper region of the roll vinyl film by using a heating wire. For example, the joining device (not illustrated) may include a first joining member (not illustrated) and a second joining member (not illustrated). The first joining member (not illustrated) may be moved in a first direction by a first joining drive part, and the second joining member (not illustrated) may be moved in a second direction perpendicular to the first direction by a second joining drive part.

With this configuration, the dust captured from the outside may be collected in the roll vinyl film, and the roll vinyl film may be automatically joined. Therefore, it is not necessary for the user to separately tie a bag in which the dust is captured, and as a result, it is possible to improve convenience for the user.

Cleaner Station

Figure 3:
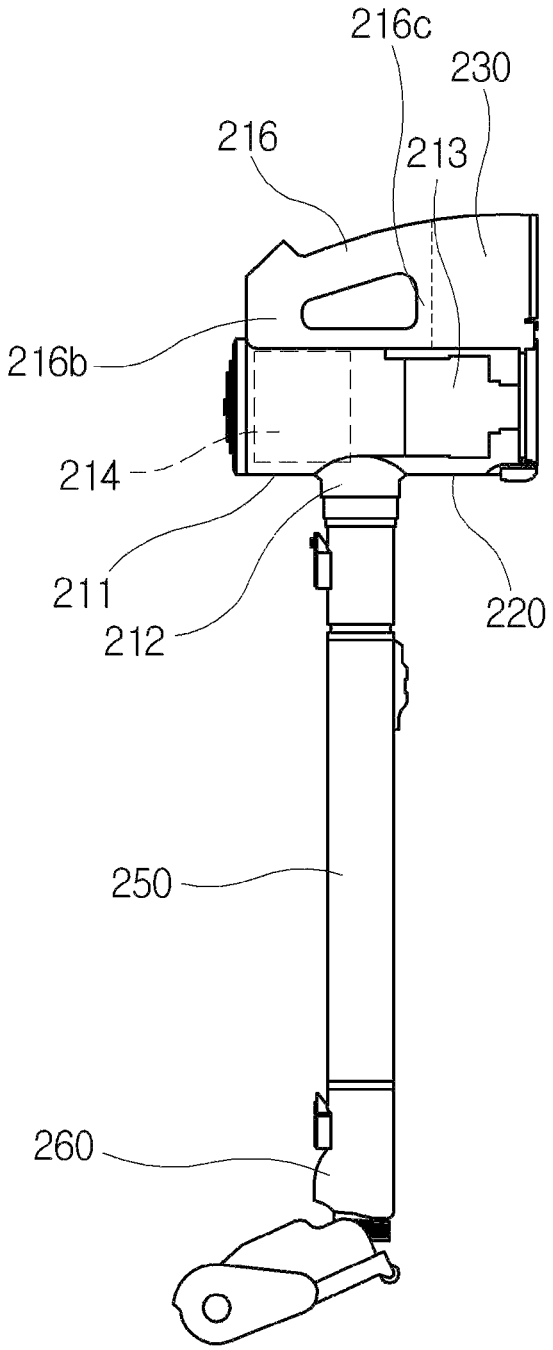
FIG. 3 is a view for explaining the cleaner in a cleaner system according to the embodiment of the present disclosure.
Figure 4:
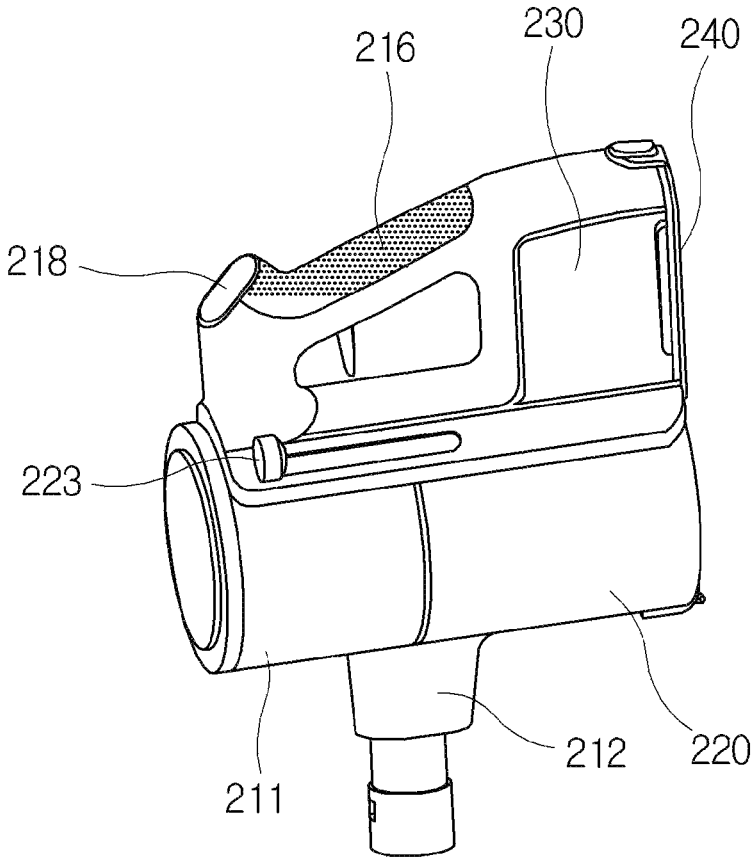
FIG. 4 is a view illustrating the cleaner in FIG. 3 when viewed at another angle.
Figure 5:
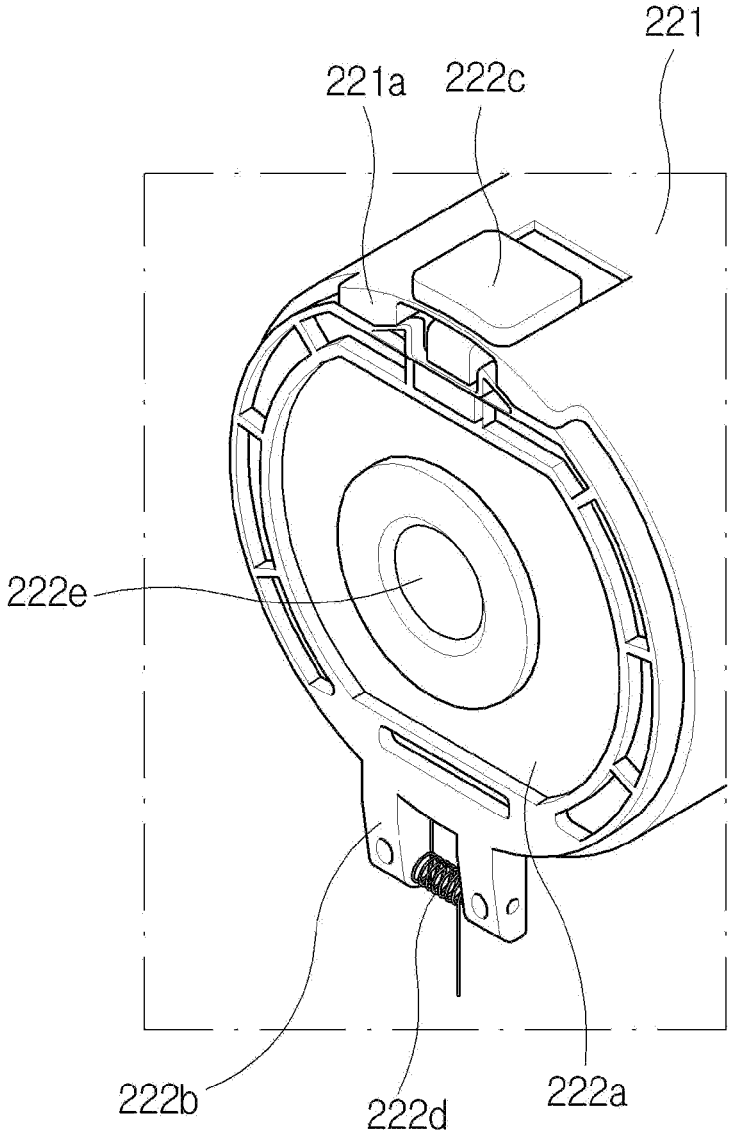
FIG. 5 is a view for explaining a lower side of a dust bin of the cleaner in the cleaner system according to the embodiment of the present disclosure.
Figure 6:
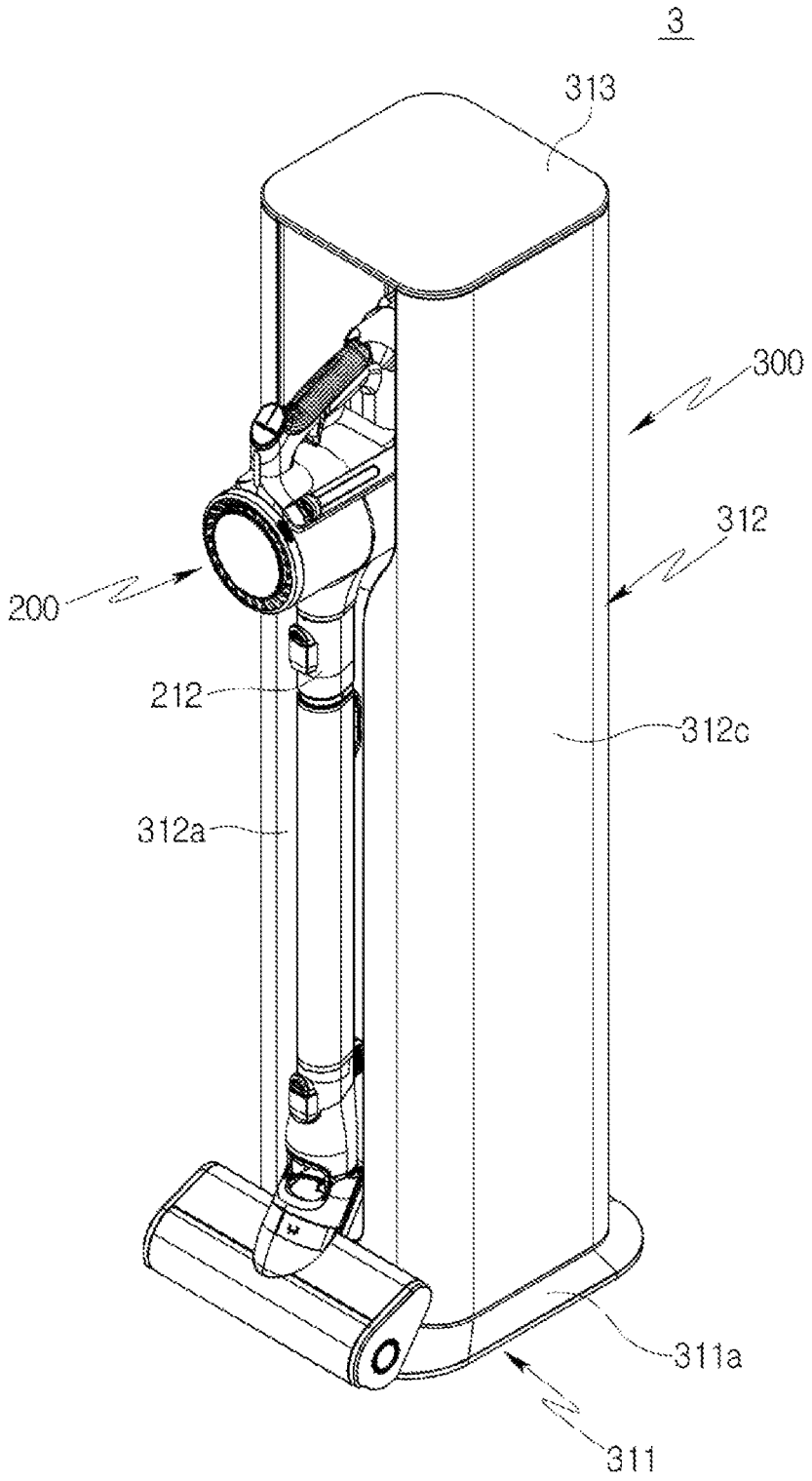
FIG. 6 is a view for explaining the cleaner system according to the embodiment of the present disclosure.

FIG. 3 is a view for explaining a cleaner 200 in a cleaner system 3 according to the embodiment of the present disclosure, FIG. 4 is a view illustrating the cleaner 200 in FIG. 3 when viewed at another angle, FIG. 5 is a view for explaining a lower side of a dust bin 220 of the cleaner 200 in the cleaner system 3 according to the embodiment of the present disclosure, and FIG. 6 is a view for explaining the cleaner system 3 according to the embodiment of the present disclosure.

With reference to FIGS. 3 to 6, the cleaner system 3 according to the embodiment of the present specification may include the cleaner 200 and a cleaner station 300.

The cleaner system 3 may include the cleaner station 300. The cleaner 200 may be coupled to the cleaner station 300. The cleaner 200 may be coupled to a lateral side of the cleaner station 300. The cleaner station 300 may remove dust from the dust bin 220 of the cleaner 200.

First, a structure of the cleaner 200 will be described below with reference to FIGS. 3 to 5.

The cleaner 200 may mean a cleaner configured to be manually operated by the user. For example, the cleaner 200 may mean a handy cleaner or a stick cleaner.

The cleaner 200 may be mounted on the cleaner station 300. The cleaner 200 may be supported by the cleaner station 300. The cleaner 200 may be coupled to the cleaner station 300.

Meanwhile, in the embodiment of the present disclosure, directions of the cleaner 200 may be defined on the basis of when a bottom surface (lower surface) of the dust bin 220 and a bottom surface (lower surface) of a battery housing 230 are placed on the ground surface.

In this case, a forward direction may mean a direction in which a suction part 212 is disposed based on a suction motor 214, and a rearward direction may mean a direction in which a handle 216 is disposed based on the suction motor 214. Further, based on a state in which the suction part 212 is viewed from the suction motor 214, a rightward direction may refer to a direction in which a component is disposed at the right, and a left direction may refer to a direction in which a component is disposed at the left. In addition, in the embodiment of the present disclosure, upper and lower sides may be defined in a direction perpendicular to the ground surface based on the state in which the bottom surface (lower surface) of the dust bin 220 and the bottom surface (lower surface) of the battery housing 230 are placed on the ground surface.

The cleaner 200 may include a main body 210. The main body 210 may include a main body housing 211, the suction part 212, a dust separating part 213, the suction motor 214, an air discharge cover 215, the handle 216, and an operating part 218.

The main body housing 211 may define an external appearance of the cleaner 200. The main body housing 211 may provide a space that may accommodate the suction motor 214 and a filter (not illustrated) therein. The main body housing 211 may be formed in a shape similar to a cylindrical shape.

The suction part 212 may protrude outward from the main body housing 211. For example, the suction part 212 may be formed in a cylindrical shape with an opened inside. The suction part 212 may be coupled to an extension tube 250. The suction part 212 may provide a flow path (hereinafter, referred to as a 'suction flow path') through which air containing dust may flow.

Meanwhile, in the present embodiment, an imaginary line may be defined to penetrate the inside of the suction part 212 having a cylindrical shape.

The dust separating part 213 may communicate with the suction part 212. The dust separating part 213 may separate dust sucked into the dust separating part 213 through the suction part 212. A space in the dust separating part 213 may communicate with a space in the dust bin 220.

For example, the dust separating part 213 may have one or more cyclone parts capable of separating dust by using a cyclone flow. Further, the space in the dust separating part 213 may communicate with the suction flow path. Therefore, air and dust, which are sucked through the suction part 212, spirally flow along an inner circumferential surface of the dust separating part 213. Therefore, the cyclone flow may be generated in the internal space of the dust separating part 213.

The dust separating part 213 communicates with the suction part 212. The dust separating part 213 adopts a principle of a dust collector using a centrifugal force to separate the dust sucked into the main body 210 through the suction part 212.

The dust separating part 213 may further include a secondary cyclone part configured to separate again dust from the air discharged from the cyclone part. In this case, the secondary cyclone part may be positioned in the cyclone part to minimize a size of the dust separating part. The secondary cyclone part may include a plurality of cyclone bodies disposed in parallel. The air discharged from the cyclone part may be distributed to and pass through the plurality of cyclone bodies.

In this case, an axis of a cyclone flow of the secondary cyclone part may also extend in an upward/downward direction. The axis of the cyclone flow of the cyclone part and the axis of the cyclone flow of the secondary cyclone part may be disposed coaxially in the upward/downward direction and collectively called an axis of the cyclone flow of the dust separating part 213.

The suction motor 214 may generate a suction force for sucking air. The suction motor 214 may be accommodated in the main body housing 211. The suction motor 214 may generate the suction force while rotating. For example, the suction motor 214 may be formed in a shape similar to a cylindrical shape.

Meanwhile, in the present embodiment, an imaginary suction motor axis may be formed by extending a rotation axis of the suction motor 214.

The air discharge cover 215 may be disposed at one side of the main body housing 211 based on an axial direction. The air discharge cover 215 may accommodate the filter for filtering air. For example, an HEPA filter may be accommodated in the air discharge cover 215.

The air discharge cover 215 may have an air discharge port for discharging the air introduced by the suction force of the suction motor 214.

A flow guide may be disposed on the air discharge cover 215. The flow guide may guide a flow of the air to be discharged through the air discharge port.

The handle 216 may be gripped by the user. The handle 216 may be disposed rearward of the suction motor 214. For example, the handle 216 may be formed in a shape similar to a cylindrical shape. Alternatively, the handle 216 may be formed in a curved cylindrical shape. The handle 216 may be disposed at a predetermined angle with respect to the main body housing 211, the suction motor 214, or the dust separating part 213.

The handle 216 may include a grip portion 216*a* formed in a column shape so that the user may grip the grip portion 216*a*, a first extension portion 216*b* connected to one end of the grip portion 216*a* based on the longitudinal direction (axial direction) and extending toward the suction motor 214, and a second extension portion 216*c* connected to the other end of the grip portion 216*a* based on the longitudinal direction (axial direction) and extending toward the dust bin 220.

Meanwhile, in the present embodiment, an imaginary grip portion through line may be formed to extend in the longitudinal direction of the grip portion 216*a* (the axial direction of the column) and penetrate the grip portion.

For example, the grip portion through line may be an imaginary line formed in the handle 216 having a cylindrical shape, that is, an imaginary line formed in parallel with at least a part of an outer surface (outer circumferential surface) of the grip portion.

An upper side of the handle 216 may define an external appearance of a part of an upper side of the cleaner 200. Therefore, it is possible to prevent a component of the cleaner 200 from coming into contact with the user's arm when the user grips the handle 216.

The first extension portion may extend from the grip portion toward the main body housing 211 or the suction motor 214. At least a part of the first extension portion may extend in a horizontal direction.

The second extension portion may extend from the grip portion toward the dust bin 220. At least a part of the second extension portion may extend in the horizontal direction.

The operating part 218 may be disposed on the handle 216. The operating part 218 may be disposed on an inclined surface formed in an upper region of the handle 216. The user may input a command for operating or stopping the cleaner 200 through the operating part 218.

The cleaner 200 may include the dust bin 220. The dust bin 220 may communicate with the dust separating part 213. The dust bin 220 may store the dust separated by the dust separating part 213.

The dust bin 220 may include a dust bin main body 221, a discharge cover 222, a dust bin compression lever 223, and a compression member (not illustrated).

The dust bin main body 221 may provide a space capable of storing the dust separated by the dust separating part 213. For example, the dust bin main body 221 may be formed in a shape similar to a cylindrical shape.

Meanwhile, in the present embodiment, an imaginary dust bin through line may be formed to penetrate the inside (internal space) of the dust bin main body 221 and extend in the longitudinal direction of the dust bin main body 221 (that means the axial direction of the cylindrical dust bin main body 221).

A part of a lower side (bottom side) of the dust bin main body 221 may be opened. In addition, a lower extension portion 221*a* may be formed at the lower side (bottom side) of the dust bin main body 221. The lower extension portion 221*a* may be formed to block a part of the lower side of the dust bin main body 221.

The dust bin 220 may include the discharge cover 222. The discharge cover 222 may be disposed at a lower side of the dust bin 220.

The discharge cover 222 may be provided to open or close one end of the dust bin main body 221 based on the longitudinal direction. Specifically, the discharge cover 222 may selectively open or close the lower side of the dust bin 220 that is opened downward.

The discharge cover 222 may include a cover main body 222*a* and a hinge part 222*b*. The cover main body 222*a* may be formed to block a part of the lower side of the dust bin main body 221. The cover main body 222*a* may be rotated downward about the hinge part 222*b*. The hinge part 222*b* may be disposed adjacent to the battery housing 230. The hinge part 222*b* may have a torsion spring 222*d*. Therefore, when the discharge cover 222 is separated from the dust bin main body 221, an elastic force of the torsion spring 222*d* may support the cover main body 222*a* in a state in which the cover main body 222*a* is rotated by a predetermined angle or more about the hinge part 222*b* with respect to the dust bin main body 221.

The discharge cover 222 may be coupled to the dust bin 220 by a hook engagement. Meanwhile, the discharge cover 222 may be separated from the dust bin 220 by means of a coupling lever 222*c*. The coupling lever 222*c* may be disposed at a front side of the dust bin. Specifically, the coupling lever 222*c* may be disposed on an outer surface at the front side of the dust bin 220. When an external force is applied, the coupling lever 222*c* may elastically deform a hook, which extends from the cover main body 222*a*, in order to release the hook engagement between the cover main body 222*a* and the dust bin main body 221.

When the discharge cover 222 is closed, the lower side of the dust bin 220 may be blocked (sealed) by the discharge cover 222 and the lower extension portion 221*a*.

The dust bin 220 may include the dust bin compression lever 223 (see FIG. 4). The dust bin compression lever 223 may be disposed outside the dust bin 220 or the dust separating part 213. The dust bin compression lever 223 may be disposed outside the dust bin 220 or the dust separating part 213 so as to be movable upward and downward. The dust bin compression lever 223 may be connected to the compression member (not illustrated). When the dust bin compression lever 223 is moved downward by an external force, the compression member (not illustrated) may also be moved downward. Therefore, it is possible to provide convenience for the user. The compression member (not illustrated) and the dust bin compression lever 223 may return back to original positions by an elastic member (not illustrated). Specifically, when the external force applied to the dust bin compression lever 223 is eliminated, the elastic member may move the dust bin compression lever 223 and the compression member (not illustrated) upward.

The compression member (not illustrated) may be disposed in the dust bin main body 221. The compression member may move in the internal space of the dust bin main body 221. Specifically, the compression member may move upward and downward in the dust bin main body 221. Therefore, the compression member may compress downward the dust in the dust bin main body 221. In addition, when the discharge cover 222 is separated from the dust bin main body 221 and thus the lower side of the dust bin 220 is opened, the compression member may move from an upper side of the dust bin 220 to the lower side of the of the dust bin 220, thereby removing debris such as residual dust in the dust bin 220. Therefore, it is possible to improve the suction force of the cleaner by preventing the residual dust from remaining in the dust bin 220. Further, it is possible to remove an offensive odor caused by the residual dust by preventing the residual dust from remaining in the dust bin 220.

The cleaner 200 may include the battery housing 230. A battery 240 may be accommodated in the battery housing 230. The battery housing 230 may be disposed below the handle 216. For example, the battery housing 230 may have a hexahedral shape opened at a lower side thereof. A rear side of the battery housing 230 may be connected to the handle 216.

The battery housing 230 may include an accommodation portion opened downward. The battery 240 may be attached or detached through the accommodation portion of the battery housing 230.

The cleaner 200 may include the battery 240.

For example, the battery 240 may be separably coupled to the cleaner 200. The battery 240 may be separably coupled to the battery housing 230. For example, the battery 240 may be inserted into the battery housing 230 from the lower side of the battery housing 230. With this configuration, the portability of the cleaner 200 may be improved.

On the contrary, the battery 240 may be integrally provided in the battery housing 230. In this case, a lower surface of the battery 240 is not exposed to the outside.

The battery 240 may supply power to the suction motor 214 of the cleaner 200. The battery 240 may be disposed on a lower portion of the handle 216. The battery 240 may be disposed at a rear side of the dust bin 220.

In case that the battery 240 is coupled to the battery housing 230 in accordance with the embodiment, the lower surface of the battery 240 may be exposed to the outside. Because the battery 240 may be placed on the floor when the cleaner 200 is placed on the floor, the battery 240 may be immediately separated from the battery housing 230. In addition, because the lower side of the battery 240 is exposed to the outside and thus in direct contact with the air present outside the battery 240, the performance in cooling the battery 240 may be improved.

Meanwhile, in case that the battery 240 is fixed integrally to the battery housing 230, the number of structures for attaching or detaching the battery 240 and the battery housing 230 may be reduced, and as a result, it is possible to reduce an overall size of the cleaner 200 and a weight of the cleaner 200.

The cleaner 200 may include the extension tube 250. The extension tube 250 may communicate with a cleaning module 260. The extension tube 250 may communicate with the main body 210. The extension tube 250 may communicate with the suction part 212 of the main body 210. The extension tube 250 may be formed in a long cylindrical shape.

The main body 210 may be connected to the extension tube 250. The main body 210 may be connected to the cleaning module 260 through the extension tube 250. The main body 210 may generate the suction force by means of the suction motor 214 and provide the suction force to the cleaning module 260 through the extension tube 250. The outside dust may be introduced into the main body 210 through the cleaning module 260 and the extension tube 250.

The cleaner 200 may include the cleaning module 260. The cleaning module 260 may communicate with the extension tube 250. Therefore, the outside air may be introduced into the main body 210 of the cleaner 200 via the cleaning module 260 and the extension tube 250 by the suction force generated in the main body 210 of the cleaner 200.

The dust in the dust bin 220 of the cleaner 200 may be captured by a dust collecting part 370 of the cleaner station 300 by gravity and a suction force of a dust collecting motor 391. Therefore, it is possible to remove the dust in the dust bin without the user's separate manipulation, thereby providing convenience for the user. In addition, it is possible to eliminate the inconvenience caused because the user needs to empty the dust bin all the time. In addition, it is possible to prevent the dust from scattering when emptying the dust bin.

The cleaner 200 may be coupled to a lateral surface of a housing 310. Specifically, the main body 210 of the cleaner 200 may be mounted on a coupling part 320. More specifically, the dust bin 220 and the battery housing 230 of the cleaner 200 may be coupled to a coupling surface 321, an outer circumferential surface of the dust bin main body 221 may be coupled to a dust bin guide surface 322, and the suction part 212 may be coupled to a suction part guide surface 326 of the coupling part 320. In this case, a central axis of the dust bin 220 may be disposed in a direction parallel to the ground surface, and the extension tube 250 may be disposed in a direction perpendicular to the ground surface.

Figure 7:
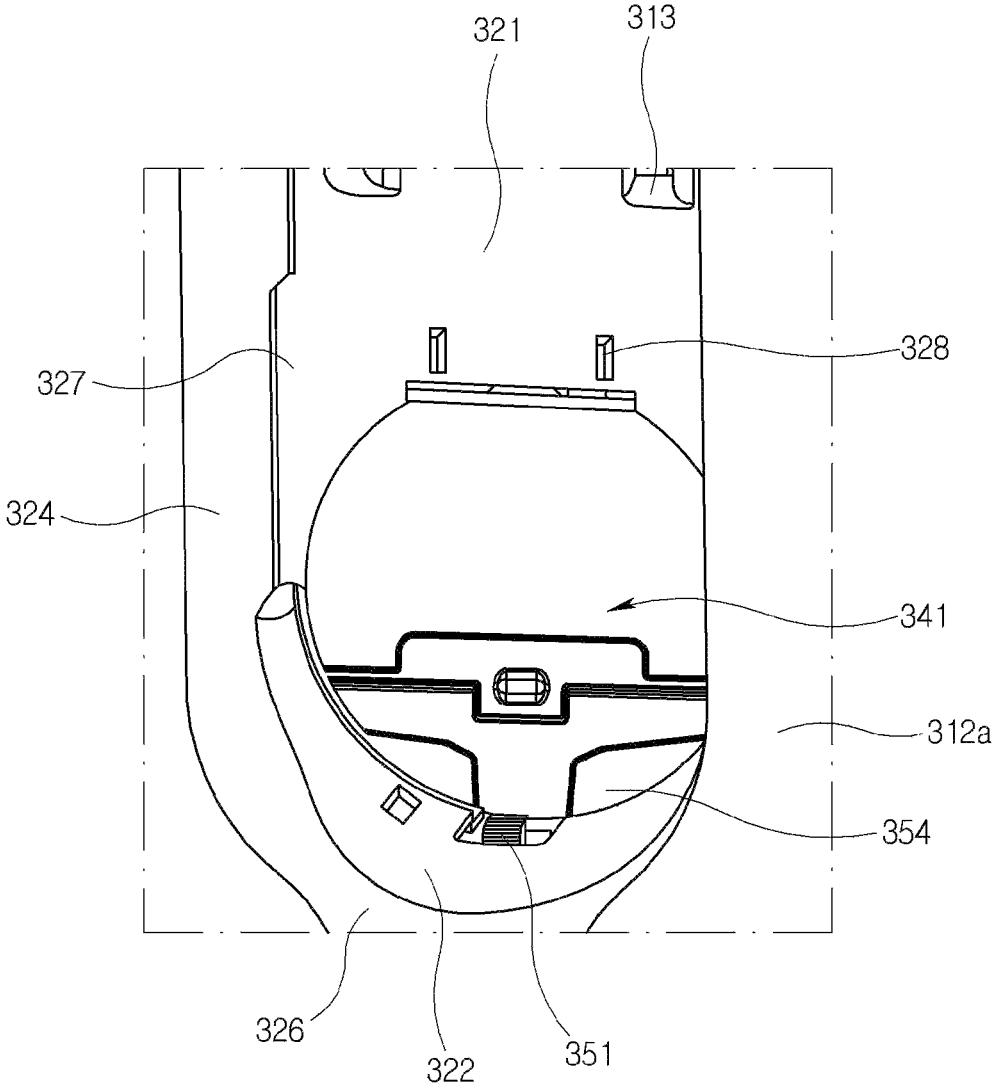
FIG. 7 is a view for explaining a coupling part of a cleaner station according to the embodiment of the present disclosure.
Figure 8:
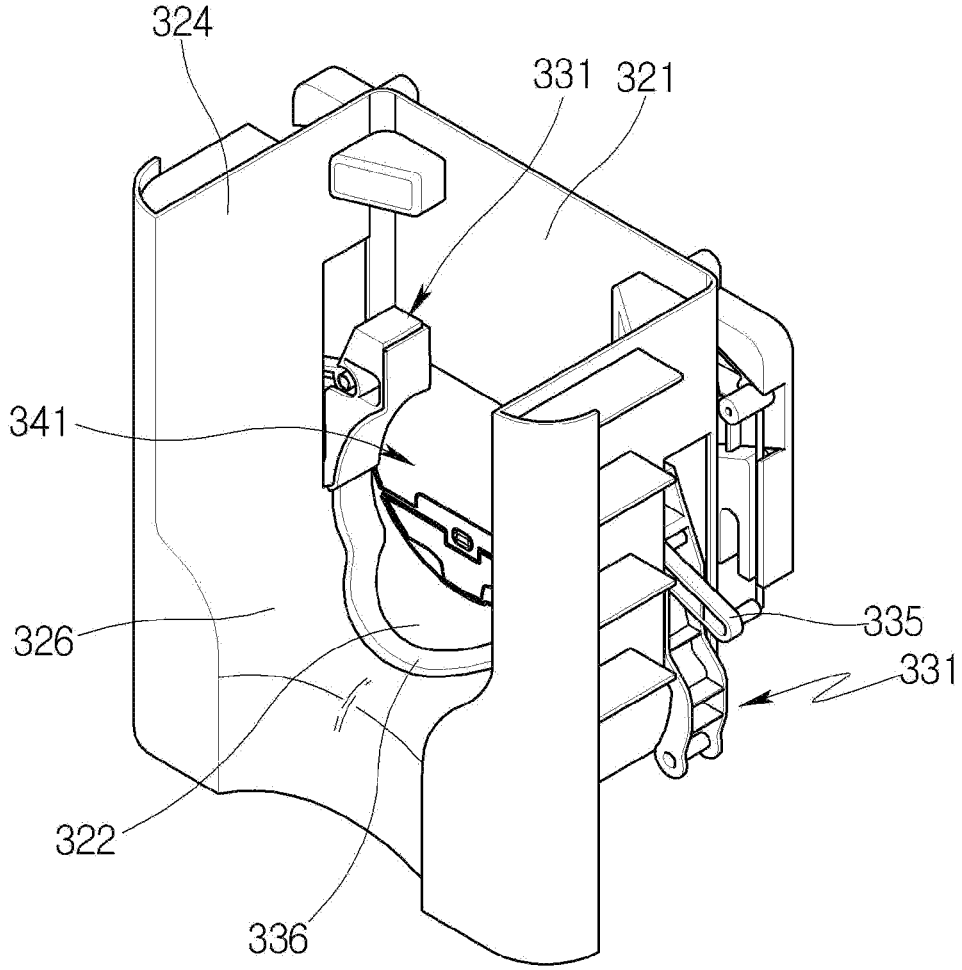
FIG. 8 is an exploded perspective view for explaining a fixing unit of the cleaner station according to the embodiment of the present disclosure.
Figure 9:
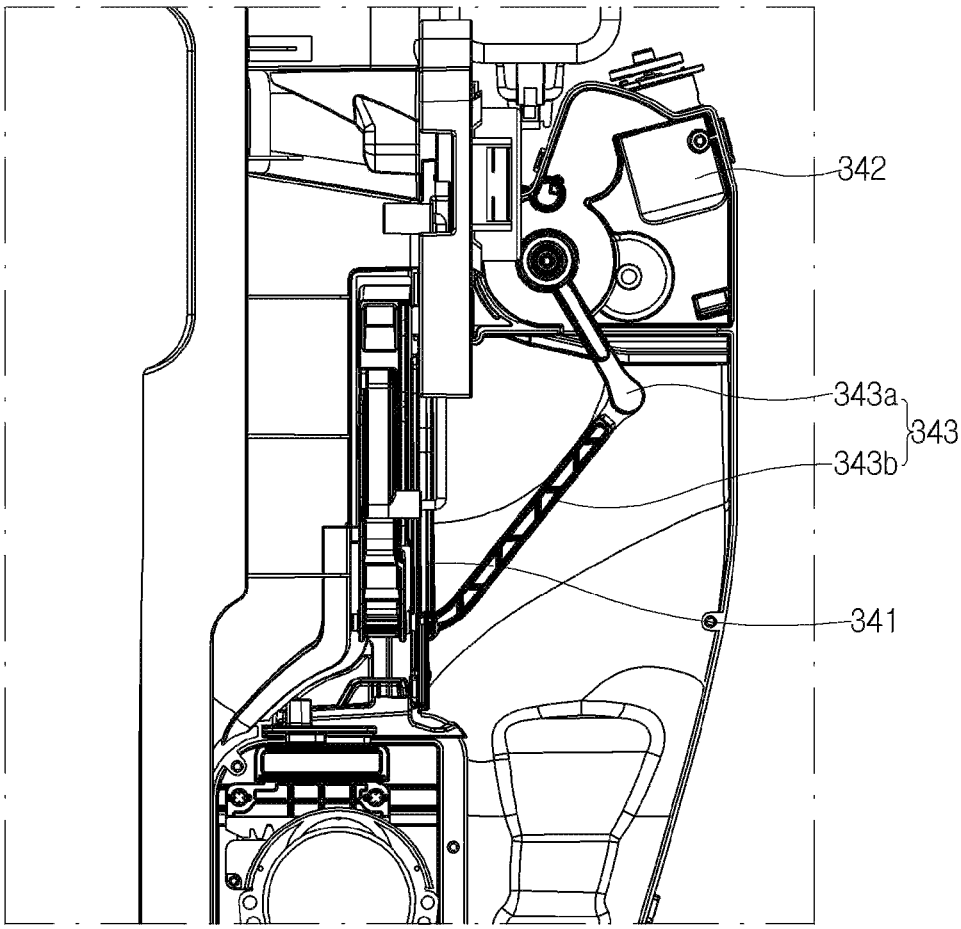
FIGS. 9 and 10 are views for explaining a relationship between the cleaner and a door unit in the cleaner station according to the embodiment of the present disclosure.
Figure 10:
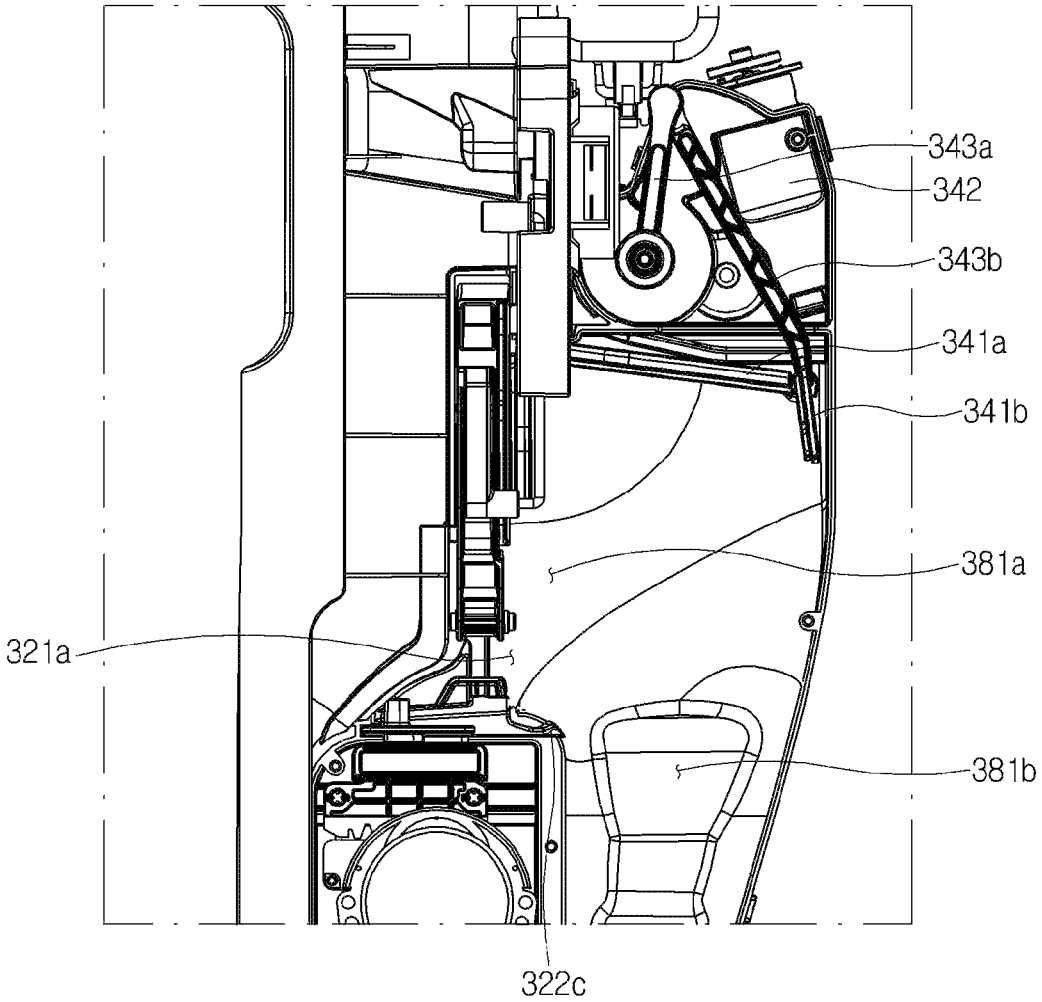
Figure 11:
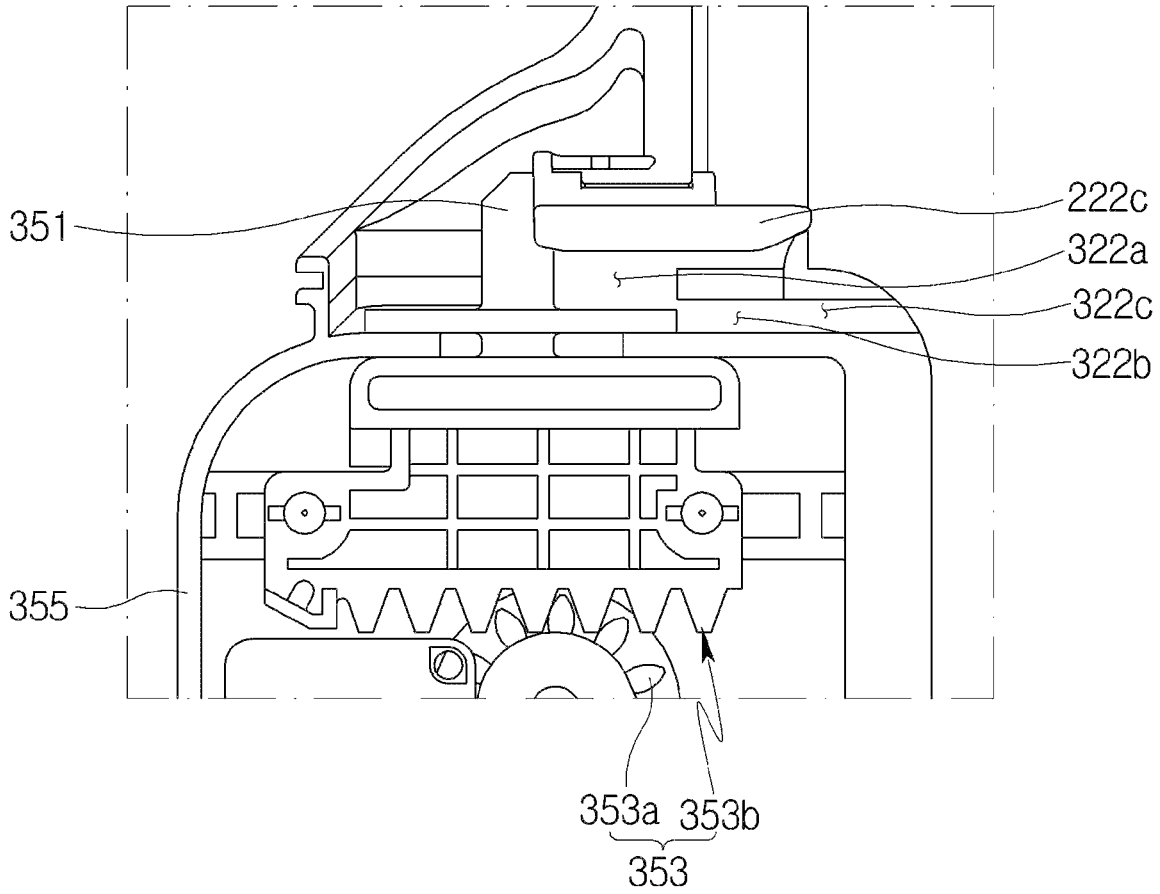
FIG. 11 is a view for explaining a relationship between the cleaner and a cover opening unit in the cleaner station according to the embodiment of the present disclosure.
Figure 12:
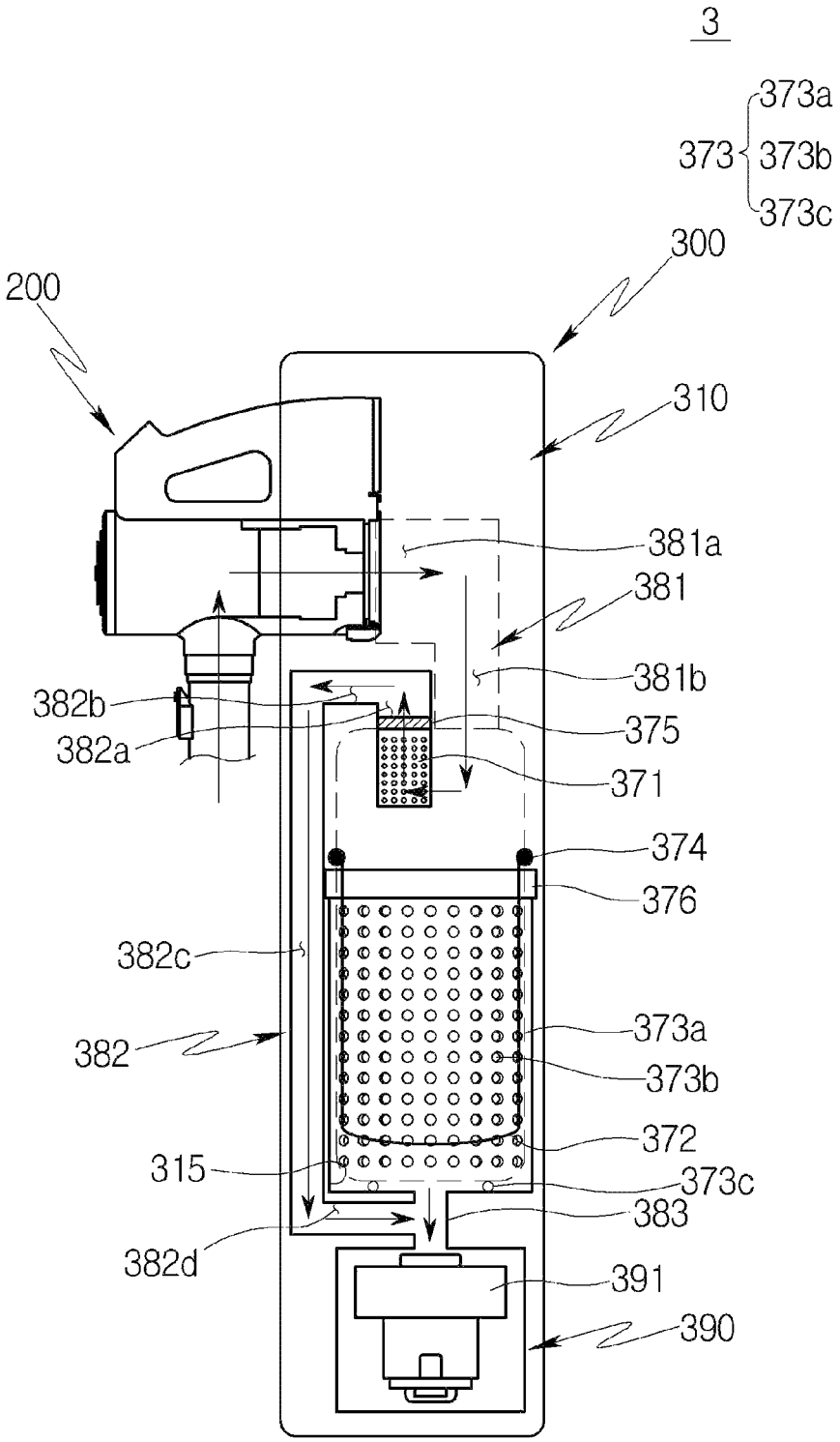
FIG. 12 is a view for explaining a process of guiding dust to a dust collecting part and a flow path part in the cleaner station according to the embodiment of the present disclosure.

FIG. 7 is a view for explaining the coupling part in the cleaner station according to the embodiment of the present disclosure, FIG. 8 is a view for explaining a fixing unit in the cleaner station according to the embodiment of the present disclosure, FIGS. 9 and 10 are views for explaining a relationship between the cleaner and a door unit in the cleaner station according to the embodiment of the present disclosure, FIG. 11 is a view for explaining a relationship between the cleaner and a cover opening unit in the cleaner station according to the embodiment of the present disclosure, and FIG. 12 is a view for explaining a process of guiding the dust to the dust collecting part and the flow path part in the cleaner system according to the embodiment of the present disclosure.

The cleaner station 300 of the present disclosure will be described below with reference to FIGS. 6 to 12.

The cleaner 200 may be coupled to the cleaner station 300. Specifically, the main body of the cleaner 200 may be coupled to the lateral surface of the cleaner station 300. The cleaner station 300 may remove dust from the dust bin 220 of the cleaner 200.

The cleaner station 300 may include the housing 310. The housing 310 may define an external appearance of the cleaner station 300. Specifically, the housing 310 may be provided in the form of a column including one or more outer wall surfaces. For example, the housing 310 may be formed in a shape similar to a quadrangular column.

The housing 310 may have a space capable of accommodating the dust collecting part 370 configured to store dust therein, and a dust suction module 390 configured to generate a flow force for collecting the dust in the dust collecting part 370.

The housing 310 may include a bottom surface 311, an outer wall surface 312, and an upper surface 313.

The bottom surface 311 may support a lower side of the dust suction module 390 based on the gravitational direction. That is, the bottom surface 311 may support a lower side of the dust collecting motor 391 of the dust suction module 390.

In this case, the bottom surface 311 may be disposed toward the ground surface. The bottom surface 311 may also be disposed in parallel with the ground surface or disposed to be inclined at a predetermined angle with respect to the ground surface. The above-mentioned configuration may be advantageous in stably supporting the dust collecting motor 391 and maintaining balance of an overall weight even in a case in which the cleaner 200 is coupled.

Meanwhile, according to the embodiment, the bottom surface 311 may further include a ground surface support portion 311*a* in order to prevent the cleaner station 300 from falling down and increase an area being in contact with the ground surface to maintain the balance. For example, the ground surface support portion 311*a* may have a plate shape extending from the bottom surface 311, and one or more frames may protrude and extend from the bottom surface 311 in the direction of the ground surface.

The outer wall surface 312 may mean a surface formed in the gravitational direction or a surface connected to the bottom surface 311. For example, the outer wall surface 312 may mean a surface connected to the bottom surface 311 so as to be perpendicular to the bottom surface 311. As another embodiment, the outer wall surface 312 may be disposed to be inclined at a predetermined angle with respect to the bottom surface 311.

The outer wall surface 312 may include at least one surface. For example, the outer wall surface 312 may include a first outer wall surface 312*a*, a second outer wall surface 312*b*, a third outer wall surface 312*c*, and a fourth outer wall surface 312*d*.

In this case, in the present embodiment, the first outer wall surface 312*a* may be disposed at the front side of the cleaner station 300. In this case, the front side may mean a side at which the cleaner 200 is exposed in the state in which the cleaner 200 is coupled to the cleaner station 300. Therefore, the first outer wall surface 312*a* may define an external appearance of the front side of the cleaner station 300.

Meanwhile, the directions are defined as follows to understand the present embodiment. In the present embodiment, the directions may be defined in the state in which the cleaner 200 is mounted on the cleaner station 300.

In the state in which the cleaner 200 is mounted on the cleaner station 300, a direction in which the cleaner 200 is exposed to the outside of the cleaner station 300 may be referred to as a forward direction.

In another point of view, in the state in which the cleaner 200 is mounted on the cleaner station 300, a direction in which the suction motor 214 of the cleaner 200 is disposed may be referred to as the forward direction. Further, a direction opposite to the direction in which the suction motor 214 is disposed on the cleaner station 300 may be referred to as a rearward direction.

Further, based on the internal space of the housing 310, a surface facing the front surface may be referred to as a rear surface of the cleaner station 300. Therefore, the rear surface may mean a direction in which the second outer wall surface 312*b* is formed.

Further, based on the internal space of the housing 310, a left surface when viewing the front surface may be referred to as a left surface, and a right surface when viewing the front surface may be referred to as a right surface. Therefore, the left surface may mean a direction in which the third outer wall surface 312*c* is formed, and the right surface may mean a direction in which the fourth outer wall surface 312*d* is formed.

The first outer wall surface 312*a* may be formed in the form of a flat surface, or the first outer wall surface 312*a* may be formed in the form of a curved surface as a whole or formed to partially include a curved surface.

The coupling part 320 may be disposed on the first outer wall surface 312*a*. With this configuration, the cleaner 200 may be coupled to the cleaner station 300 and supported by the cleaner station 300. The specific configuration of the coupling part 320 will be described below.

Meanwhile, a structure for mounting various types of cleaning modules 260 used for the cleaner 200 may be additionally provided on the first outer wall surface 312*a*.

In the present embodiment, the second outer wall surface 312*b* may be a surface facing the first outer wall surface 312*a*. That is, the second outer wall surface 312*b* may be disposed on the rear surface of the cleaner station 300. The second outer wall surface 312*b* may define an external appearance of the rear surface of the cleaner station 300.

In the present embodiment, the third outer wall surface 312*c* and the fourth outer wall surface 312*d* may mean surfaces that connect the first outer wall surface 312*a* and the second outer wall surface 312*b*. In this case, the third outer wall surface 312*c* may be disposed on the left surface of the cleaner station 300, and the fourth outer wall surface 312*d* may be disposed on the right surface of the cleaner station 300. On the contrary, the third outer wall surface 312*c* may be disposed on the right surface of the cleaner station 300, and the fourth outer wall surface 312*d* may be disposed on the left surface of the cleaner station 300.

The third outer wall surface 312*c* or the fourth outer wall surface 312*d* may be formed in the form of a flat surface, or the third outer wall surface 312*c* or the fourth outer wall surface 312*d* may be formed in the form of a curved surface as a whole or formed to partially include a curved surface.

Meanwhile, the structure for mounting various types of cleaning modules 290 used for the cleaner 200 may be additionally provided on the third outer wall surface 312*c* or the fourth outer wall surface 312*d*.

The upper surface 313 may define an upper external appearance of the cleaner station. That is, the upper surface 313 may mean a surface disposed at an outermost side of the cleaner station in the gravitational direction and exposed to the outside.

For reference, in the present embodiment, the terms 'upper side' and 'lower side' may mean the upper and lower sides in the gravitational direction (a direction perpendicular to the ground surface) in the state in which the cleaner station 300 is installed on the ground surface.

In this case, the upper surface 313 may also be disposed in parallel with the ground surface or disposed to be inclined at a predetermined angle with respect to the ground surface.

A display part may be disposed on the upper surface 313. For example, the display part may display a state of the cleaner station 300 and a state of the cleaner 200. The display part may further display information such as a cleaning process situation, a map of the cleaning zone, and the like.

Meanwhile, according to the embodiment, the upper surface 313 may be separable from the outer wall surface 312. In this case, when the upper surface 313 is separated, the battery separated from the cleaner 200 may be accommodated in the internal space surrounded by the outer wall surface 312, and a terminal (not illustrated) capable of charging the separated battery may be provided in the internal space.

Meanwhile, a bag accommodation space 315 may be formed in the housing 310. The bag accommodation space 315 may be disposed at a lower side of the coupling part 320 based on the gravitational direction and disposed above the dust suction module 390 based on the gravitational direction.

The dust collecting part 370 may be provided in the bag accommodation space 315. Specifically, a bag support part 373 to be described below may be accommodated in the bag accommodation space 315 so that the bag support part 373 may enter or exit the bag accommodation space 315. Further, a dust bag cartridge 374 to be described below may be detachably coupled to the bag accommodation space 315. In addition, a joining device 376 to be described below may be mounted in the bag accommodation space 315. The bag accommodation space 315 may communicate with a first flow path 381, a second flow path 382, and a bypass flow path 383 that will be described below. With this configuration, the bag accommodation space 315 may provide a space in which air and dust, which are introduced from the dust bin 220, may flow and be captured in a dust bag 372.

Meanwhile, the state in which the cleaner 200 is coupled to the cleaner station 300 will be described below with reference to FIGS. 6 and 12.

In the present disclosure, the cleaner 200 may be mounted on the outer wall surface 312 of the cleaner station 300. For example, the dust bin 220 and the battery housing 230 of the cleaner 200 may be coupled to the coupling surface 321 of the cleaner station 300. That is, the cleaner 200 may be mounted on the first outer wall surface 312*a*.

In this case, an axis of the suction motor 214 may be defined to be perpendicular to the first outer wall surface 312*a*. That is, the axis of the suction motor 214 may be defined in parallel with the ground surface.

An imaginary line, which penetrates the dust bin 220, may be defined to be perpendicular to the first outer wall surface 312*a*.

A longitudinal axis C of the housing 310 may be defined to be perpendicular to the ground surface. The longitudinal axis C of the housing 310 may be defined in parallel with at least any one of the first outer wall surface 312*a*, the second outer wall surface 312*b*, the third outer wall surface 312*c*, and the fourth outer wall surface 312*d*.

When the cleaner 200 is coupled to the cleaner station 300, the axis of the suction motor 214 may intersect the longitudinal axis of the cleaner station 300. That is, a rotation axis of the suction motor 214 may intersect the longitudinal axis of the cleaner station 300.

In addition, when the cleaner 200 is coupled to the cleaner station 300, the battery 240 may be disposed to be farther from the ground surface than the rotation axis of the suction motor 214 from the ground surface. With this configuration, the cleaner 200 may be stably supported on the cleaner station 300.

When the cleaner 200 is coupled to the cleaner station 300, the imaginary line, which penetrates the dust bin 220, may intersect the longitudinal axis of the cleaner station 300. That is, the longitudinal axis of the dust bin 220 may intersect the longitudinal axis of the cleaner station 300. In this case, an intersection point between the longitudinal axis of the dust bin 220 and the longitudinal axis of the cleaner station 300 may be positioned in the housing 310, and more particularly, positioned in a flow path part 380.

Meanwhile, when the cleaner 200 is coupled to the cleaner station 300, the handle 216 may be disposed to be farther from the ground surface than the imaginary line, which penetrates the dust bin 220, from the ground surface. With this configuration, when the user grips the handle 216, the user may couple or separate the cleaner 200 to/from the cleaner station 300 only by simply moving the cleaner 200 in the direction parallel to the ground surface. As a result, it is possible to provide convenience for the user.

The coupling part 320 of the cleaner station 300 according to the present disclosure will be described below with reference to FIG. 7.

The cleaner station 300 may include the coupling part 320 to which the cleaner 200 is coupled. Specifically, the coupling part 320 may be disposed in the first outer wall surface 312*a*, and the main body 210, the dust bin 220, and the battery housing 230 of the cleaner 200 may be coupled to the coupling part 320.

The coupling part 320 may include the coupling surface 321. The coupling surface 321 may be disposed on the lateral surface of the housing 310. For example, the coupling surface 321 may mean a surface formed in the form of a groove which is concave toward the inside of the cleaner station 300 from the first outer wall surface 312*a*. That is, the coupling surface 321 may mean a surface formed to have a stepped portion with respect to the first outer wall surface 312*a*.

The cleaner 200 may be coupled to the coupling surface 321. For example, the coupling surface 321 may be in contact with the lower surface of the dust bin 220 and the lower surface of the battery housing 230 of the cleaner 200. In this case, the lower surface may mean a surface directed toward the ground surface when the user uses the cleaner 200 or places the cleaner 200 on the ground surface.

For example, an angle of the coupling surface 321 with respect to the ground surface may be a right angle. Therefore, it is possible to minimize a space of the cleaner station 300 when the cleaner 200 is coupled to the coupling surface 321.

As another example, the coupling surface 321 may be disposed to be inclined at a predetermined angle with respect to the ground surface. Therefore, the cleaner station 300 may be stably supported when the cleaner 200 is coupled to the coupling surface 321.

The coupling surface 321 may have a dust passage hole 321*a* through which air present outside the housing 310 may be introduced into the housing 310. The dust passage hole 321*a* may be formed in the form of a hole corresponding to the shape of the dust bin 220 so that the dust in the dust bin 220 may be introduced into the dust collecting part 370. The dust passage hole 321*a* may be formed to correspond to the shape of the discharge cover 222 of the dust bin 220. The dust passage hole 321*a* may be formed to communicate with the flow path part 380 to be described below (see FIG. 10).

The coupling part 320 may include the dust bin guide surface 322. The dust bin guide surface 322 may be disposed on the first outer wall surface 312*a*. The dust bin guide surfaces 322 may be connected to the first outer wall surface 312*a*. In addition, the dust bin guide surface 322 may be connected to the coupling surface 321.

The dust bin guide surface 322 may be formed in a shape corresponding to the outer surface of the dust bin 220. A front outer surface of the dust bin 220 may be coupled to the dust bin guide surface 322. Therefore, it is possible to provide the convenience when coupling the cleaner 200 to the coupling surface 321.

Meanwhile, a protrusion moving hole 322*a* may be formed in the dust bin guide surface 322, and a push protrusion 351 to be described below may rectilinearly move along the protrusion moving hole 322*a* (see FIG. 11). In addition, a gearbox 355 may be provided below the dust bin guide surface 322 based on the gravitational direction and accommodate a gear or the like of a cover opening unit 350 to be described below. In this case, a guide space 322*b*, through which the push protrusion 351 may move, may be formed between the dust bin guide surface 322, the lower surface, and the upper surface of the gearbox 355. Further, the guide space 322*b* may communicate with the first flow path 381 through a bypass hole 322*c*. That is, the protrusion moving hole 322*a*, the guide space 322*b*, the bypass hole 322*c*, and the first flow path 381 may define one flow path. With this configuration, when the dust collecting motor 391 operates in the state in which the dust bin 220 is coupled to the coupling part 320, the dust or the like, which remains in the dust bin 220 and remains on the dust bin guide surface 322, may be sucked through the flow path.

The coupling part 320 may include guide protrusions 323. The guide protrusions 323 may be disposed on the coupling surface 321. The guide protrusions 323 may protrude upward from the coupling surface 321. Two guide protrusions 323 may be disposed to be spaced apart from each other. A distance between the two guide protrusions 323, which are spaced apart from each other, may correspond to a width of the battery housing 230 of the cleaner 200. Therefore, it is possible to provide the convenience when coupling the cleaner 200 to the coupling surface 321.

The coupling part 320 may include coupling part sidewalls 324. The coupling part sidewalls 324 may mean wall surfaces disposed at two opposite sides of the coupling surface 321 and may be perpendicularly connected to the coupling surface 321. The coupling part sidewalls 324 may be connected to the first outer wall surface 312*a*. In addition, the coupling part sidewalls 324 may define surfaces connected to the dust bin guide surface 322. Therefore, the cleaner 200 may be stably accommodated.

The coupling part 320 may include a coupling sensor 325. The coupling sensor 325 may detect whether the cleaner 200 is coupled to the coupling part 320.

The coupling sensor 325 may include a contact sensor. For example, the coupling sensor 325 may include a microswitch. In this case, the coupling sensor 325 may be disposed on the guide protrusion 323. Therefore, when the battery housing 230 or the battery 240 of the cleaner 200 is coupled between the pair of guide protrusions 323, the battery housing 230 or the battery 240 comes into contact with the coupling sensor 325, such that the coupling sensor 325 may detect that the cleaner 200 is coupled to the coupling part.

Meanwhile, the coupling sensor 325 may include a contactless sensor. For example, the coupling sensor 325 may include an infrared ray (IR) sensor. In this case, the coupling sensor 325 may be disposed on the coupling part sidewall 324. Therefore, when the dust bin 220 or the main body 210 of the cleaner 200 passes the coupling part sidewall 324 and then reaches the coupling surface 321, the coupling sensor 325 may detect the presence of the dust bin 220 or the main body 210.

In the state in which the cleaner 200 is coupled to the cleaner station 300, the coupling sensor 325 may face the dust bin 220 or the battery housing 230 of the cleaner 200.

The coupling sensor 325 may be a mean for determining whether the cleaner 200 is coupled and power is applied to the battery 240 of the cleaner 200.

The coupling part 320 may include the suction part guide surface 326. The suction part guide surface 326 may be disposed on the first outer wall surface 312*a*. The suction part guide surface 326 may be connected to the dust bin guide surface 322. The suction part 212 may be coupled to the suction part guide surface 326. The suction part guide surface 326 may be formed in a shape corresponding to the shape of the suction part 212.

The coupling part 320 may further include fixing member entrance holes 327. The fixing member entrance hole 327 may be formed in the form of a long hole along the coupling part sidewall 324 so that fixing members 331 may enter and exit the fixing member entrance hole 327.

With this configuration, when the user couples the cleaner 200 to the coupling part 320 of the cleaner station 300, the main body 210 of the cleaner 200 may be stably disposed on the coupling part 320 by the dust bin guide surface 322, the guide protrusions 323, and the suction part guide surface 326. Therefore, it is possible to provide convenience when coupling the dust bin 220 and the battery housing 230 of the cleaner 200 to the coupling surface 321.

Meanwhile, the cleaner station 300 may further include a charging part 328. The charging part 328 may be disposed on the coupling part 320. The charging part 328 may be electrically connected to the cleaner 200 coupled to the coupling part 320. The charging part 328 may supply power to the battery of the cleaner 200 coupled to the coupling part 320.

In addition, the cleaner station 300 may further include a lateral door (not illustrated). The lateral door may be disposed in the housing 310. The lateral door may selectively expose the dust collecting part 370 to the outside. Therefore, the user may easily remove the dust bag 372 from the cleaner station 300.

A fixing unit 330 according to the present disclosure will be described below with reference to FIG. 8.

The cleaner station 300 according to the present disclosure may include the fixing unit 330. The fixing unit 330 may be disposed on the coupling part sidewall 324. In addition, the fixing unit 330 may be disposed on a back surface to the coupling surface 321. The fixing unit 330 may fix the cleaner 200 coupled to the coupling surface 321. Specifically, the fixing unit 330 may fix the dust bin 220 and the battery housing 230 of the cleaner 200 coupled to the coupling surface 321.

The fixing unit 330 may include a fixing members 331 configured to fix the dust bin 220 and the battery housing 230 of the cleaner 200, and a fixing part motor 333 configured to operate the fixing members 331. In addition, the fixing unit 330 may further include fixing part links 335 configured to transmit power of the fixing part motor 333 to the fixing members 331.

The fixing member 331 may be disposed on the coupling part sidewall 324 and provided on the coupling part sidewall 324 so as to reciprocate in order to fix the dust bin 220. Specifically, the fixing members 331 may be accommodated in the fixing member entrance holes 327 (FIG. 8).

The fixing members 331 may be disposed at two opposite sides of the coupling part 320, respectively. For example, a pair of two fixing members 331 may be symmetrically disposed with respect to the coupling surface 321.

The fixing part motor 333 may provide power for moving the fixing member 331.

The fixing part links 335 may convert a rotational force of the fixing part motor 333 into the reciprocations of the fixing members 331.

A stationary sealer 336 may be disposed on the dust bin guide surface 322 so as to seal the dust bin 220 when the cleaner 200 is coupled. With this configuration, when the dust bin 220 of the cleaner 200 is coupled, the cleaner 200 may press the stationary sealer 336 by its own weight, such that the dust bin 220 and the dust bin guide surface 322 may be sealed.

The stationary sealer 336 may be disposed on an imaginary extension line of the fixing member 331. With this configuration, when the fixing part motor 333 operates and the fixing members 331 press the dust bin 220, a circumference of the dust bin 220 at the same height may be sealed.

According to the embodiment, the stationary sealer 336 may be disposed on the dust bin guide surface 322 and formed in the form of a bent line corresponding to an arrangement of the cover opening unit 350 to be described below.

Therefore, when the main body 210 of the cleaner 200 is disposed on the coupling part 320, the fixing unit 330 may fix the main body 210 of the cleaner 200. Specifically, when the coupling sensor 325 detects that the main body 210 of the cleaner 200 is coupled to the coupling part 320 of the cleaner station 300, the fixing part motor 333 may move the fixing members 331 to fix the main body 210 of the cleaner 200.

Therefore, it is possible to improve the suction force of the cleaner by preventing the residual dust from remaining in the dust bin. Further, it is possible to remove an offensive odor caused by the residual dust by preventing the residual dust from remaining in the dust bin.

A door unit 340 according to the present disclosure will be described below with reference to FIGS. 9 and 10.

The cleaner station 300 according to the present disclosure may include the door unit 340. The door unit 340 may be configured to open or close the dust passage hole 321*a*.

The door unit 340 may include a door 341, a door motor 342, and a door arm 343.

The door 341 may be hingedly coupled to the coupling surface 321 and may open or close the dust passage hole 321*a*. The door 341 may include a door main body 341*a*.

The door main body 341*a* may be formed in a shape capable of blocking the dust passage hole 321*a*. For example, the door main body 341*a* may be formed in a shape similar to a circular plate shape.

Based on a state in which the door main body 341*a* blocks the dust passage hole 321*a*, the hinge part may be disposed at an upper side of the door main body 341*a*, and an arm coupling part 341*b* may be disposed at a lower side of the door main body 341*a*.

The door main body 341*a* may be formed in a shape capable of sealing the dust passage hole 321*a*. For example, an outer surface of the door main body 341*a*, which is exposed to the outside of the cleaner station 300, is formed to have a diameter corresponding to a diameter of the dust passage hole 321*a*, and an inner surface of the door main body 341*a*, which is disposed in the cleaner station 300, is formed to have a diameter greater than the diameter of the dust passage hole 321*a*. In addition, a level difference may be defined between the outer surface and the inner surface. Meanwhile, one or more reinforcing ribs may protrude from the inner surface in order to connect the hinge part and the arm coupling part 341*b* and reinforce a supporting force of the door main body 341*a*.

The hinge part may be a means by which the door 341 is hingedly coupled to the coupling surface 321. The hinge part may be disposed at an upper end of the door main body 341*a* and coupled to the coupling surface 321.

The arm coupling part 341*b* may be a means to which the door arm 343 is rotatably coupled. The arm coupling part 341*b* may be disposed at a lower side of the door main body 341*a* and rotatably coupled to the door main body 341*a*, and the door arm 343 may be rotatably coupled to the arm coupling part 341*b*.

With this configuration, when the door arm 343 pulls the door main body 341*a* in the state in which the door 341 closes the dust passage hole 321*a*, the door main body 341*a* is rotated about the hinge part toward the inside of the cleaner station 300, such that the dust passage hole 321*a* may be opened. Meanwhile, when the door arm 343 pushes the door main body 341*a* in the state in which the dust passage hole 321*a* is opened, the door main body 341*a* is rotated about the hinge part 341*b* toward the outside of the cleaner station 300, such that the dust passage hole 321*a* may be closed.

Meanwhile, the door 341 may be in contact with the discharge cover 222 in the state in which the cleaner 200 is coupled to the cleaner station 300 and the discharge cover 222 is separated from the dust bin main body 210. Further, when the door 341 rotates, the discharge cover 222 may rotate in conjunction with the door 341.

The door motor 342 may provide power for rotating the door 341. Specifically, the door motor 342 may rotate the door arm 343 in a forward or reverse direction. In this case, the forward direction may mean a direction in which the door arm 343 pulls the door 341. Therefore, when the door arm 343 is rotated in the forward direction, the dust passage hole 321*a* may be opened. In addition, the reverse direction may mean a direction in which the door arm 343 pushes the door 341. Therefore, when the door arm 343 is rotated in the reverse direction, at least a part of the dust passage hole 321*a* may be closed. The forward direction may be opposite to the reverse direction.

The door arm 343 may connect the door 341 and the door motor 342 and open or close the door 341 using the power generated from the door motor 342.

For example, the door arm 343 may include a first door arm 343*a* and the second door arm 343*b*. One end of the first door arm 343*a* may be coupled to the door motor 342. The first door arm 343*a* may be rotated by the power of the door motor 342. The other end of the first door arm 343*a* may be rotatably coupled to the second door arm 343*b*. The first door arm 343*a* may transmit a force transmitted from the door motor 342 to the second door arm 343*b*. One end of the second door arm 343*b* may be coupled to the first door arm 343*a*. The other end of the second door arm 343*b* may be coupled to the door 341. The second door arm 343*b* may open or close the dust passage hole 321*a* by pushing or pulling the door 341.

The door unit 340 may further include door opening/closing detecting parts 344. The door opening/closing detecting parts 344 may be provided in the housing 100 and may detect whether the door 341 is in an opened state.

For example, the door opening/closing detecting parts 344 may be disposed at both ends in a rotational region of the door arm 343, respectively. As another example, the door opening/closing detecting parts 344 may be disposed at both ends in a movement region of the door 341, respectively.

Therefore, when the door arm 343 is moved to a preset door opening position DP1 or when the door 341 is opened to a predetermined position, the door opening/closing detecting parts 344 may detect that the door is opened. In addition, when the door arm 343 is moved to a preset door closing position DP2 or when the door 341 is opened to a predetermined position, the door opening/closing detecting parts 344 may detect that the door is opened.

The door opening/closing detecting part 344 may include a contact sensor. For example, the door opening/closing detecting part 344 may include a micro-switch.

Meanwhile, the door opening/closing detecting part 344 may also include a contactless sensor. For example, the door opening/closing detecting part 344 may include an infrared ray (IR) sensor.

With this configuration, the door unit 340 may selectively open or close at least a part of the coupling surface 321, thereby allowing the outside of the first outer wall surface 312*a* to communicate with the flow path part 380 and/or the dust collecting part 370.

The door unit 340 may be opened when the discharge cover 222 of the cleaner 200 is opened. In addition, when the door unit 340 is closed, the discharge cover 222 of the cleaner 200 may also be closed in conjunction with the door unit 340.

When the dust in the dust bin 220 of the cleaner 200 is removed, the door motor 342 may rotate the door 341, thereby coupling the discharge cover 222 to the dust bin main body 221. Specifically, the door motor 342 may rotate the door 341 to rotate the door 341 about the hinge part 341*b*, and the door 341 rotated about the hinge part 341*b* may push the discharge cover 222 toward the dust bin main body 221.

The cover opening unit 350 according to the present disclosure will be described below with reference to FIG. 11.

The cleaner station 300 according to the present disclosure may include the cover opening unit 350. The cover opening unit 350 may be disposed on the coupling part 320 and may open the discharge cover 222 of the cleaner 200.

The cover opening unit 350 may include the push protrusion 351, a cover opening motor 352, cover opening gears 353, and the gearbox 355.

The push protrusion 351 may move to press the coupling lever 222*c* when the cleaner 200 is coupled.

The push protrusion 351 may be disposed on the dust bin guide surface 322.

Specifically, the protrusion moving hole may be formed in the dust bin guide surface 322, and the push protrusion 351 may be exposed to the outside by passing through the protrusion moving hole.

When the cleaner 200 is coupled, the push protrusion 351 may be disposed at a position at which the push protrusion 351 may push the coupling lever 222*c*. That is, the coupling lever 222*c* may be disposed on the protrusion moving hole. In addition, the coupling lever 222*c* may be disposed in a movement region of the push protrusion 351.

The push protrusion 351 may rectilinearly reciprocate to press the coupling lever 222*c*. Specifically, the push protrusion 351 may be coupled to the gear box 355, such that the rectilinear movement of the push protrusion 351 may be guided. The push protrusion 351 may be coupled to the cover opening gears 353 and moved together with the cover opening gears 353 by the movements of the cover opening gears 353.

The cover opening motor 352 may provide power for moving the push protrusion 351. Specifically, the cover opening motor 352 may rotate a motor shaft (not illustrated) in a forward direction or a reverse direction. In this case, the forward direction may mean a direction in which the push protrusion 351 pushes the coupling lever 222*c*. In addition, the reverse direction may mean a direction in which the push protrusion 351, which has pushed the coupling lever 222*c*, returns back to an original position. The forward direction may be opposite to the reverse direction.

The cover opening gears 353 may be coupled to the cover opening motor 352 and may move the push protrusion 351 using the power from the cover opening motor 352. Specifically, the cover opening gears 353 may be accommodated in the gear box 355. A driving gear 353*a* of the cover opening gears 353 may be coupled to the motor shaft of the cover opening motor 352 and supplied with the power. A driven gear 353*b* of the cover opening gears 353 may be coupled to the push protrusion 351 to move the push protrusion 351. For example, the driven gear 353*b* may be provided in the form of a rack gear, engage with the driving gear 353*a*, and receive power from the driving gear 353*a*.

In this case, the discharge cover 222 may have the torsion spring 222*d*. The discharge cover 222 may be rotated by a predetermined angle or more and supported in the rotated position by an elastic force of the torsion spring 222*d*. Therefore, the discharge cover 222 may be opened, and the dust passage hole 321*a* and the inside of the dust bin 220 may communicate with each other.

The gear box 355 may be disposed in the housing 310 and disposed at the lower side of the coupling part 320 in the gravitational direction, and the cover opening gears 353 may be accommodated in the gear box 355.

Cover opening detecting parts 355*f* may be disposed on the gear box 355. In this case, the cover opening detecting part 355*f* may include a contact sensor. For example, the cover opening detecting part 355*f* may include a micro-switch. Meanwhile, the cover opening detecting part 355*f* may also include a contactless sensor. For example, the cover opening detecting part 355*f* may include an infrared (IR) sensor.

The cover opening detecting part 355*f* may be disposed on at least one of inner and outer walls of the gear box 355. For example, the single cover opening detecting part 355*f* may be disposed on the inner surface of the gear box 355. In this case, the cover opening detecting part 355*f* may detect that the push protrusion 351 is positioned at the initial position.

Accordingly, according to the present disclosure, the cover opening unit 350 may open the dust bin 220 even though the user separately opens the discharge cover 222 of the cleaner, and as a result, it is possible to improve convenience.

In addition, since the discharge cover 222 is opened in the state in which the cleaner 200 is coupled to the cleaner station 300, it is possible to prevent the dust from scattering.

Figure 13:
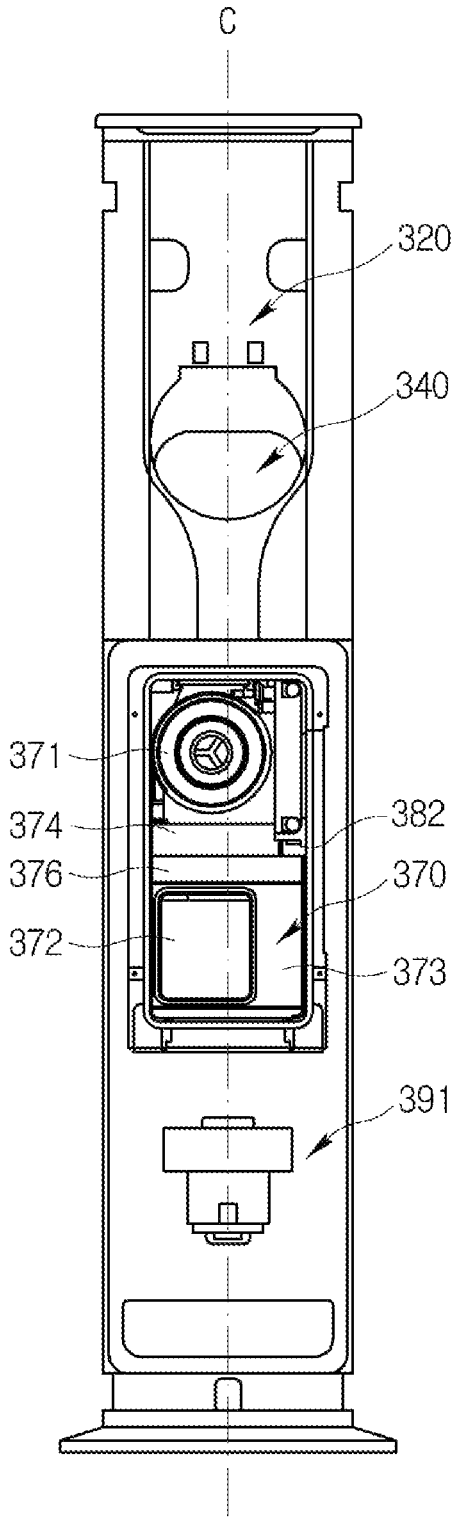
FIG. 13 is a front view for explaining the dust collecting part in the cleaner station according to the embodiment of the present disclosure.
Figure 14:
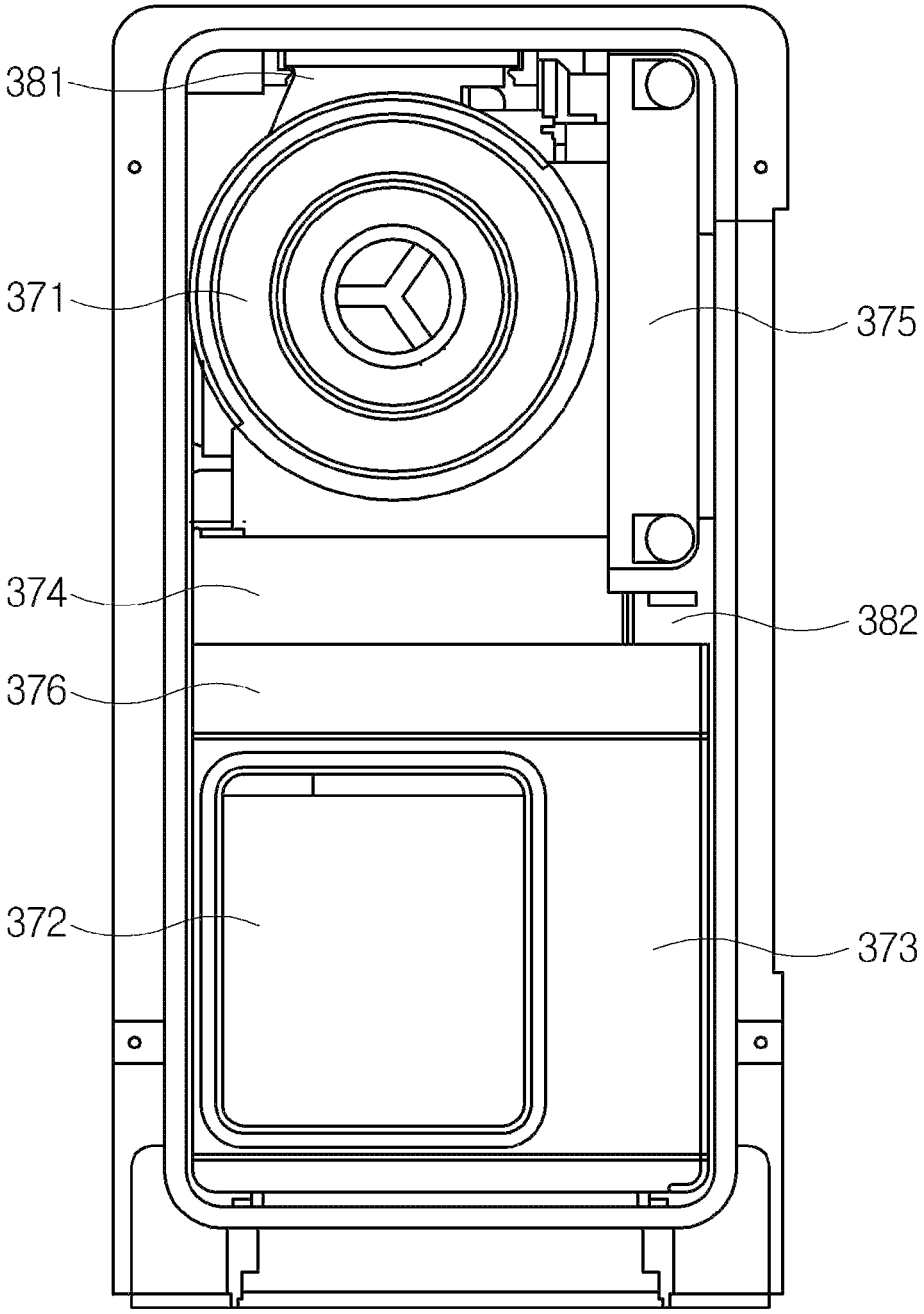
FIG. 14 is a view for explaining a specific arrangement and configuration of the dust collecting part in FIG. 13.
Figure 15:
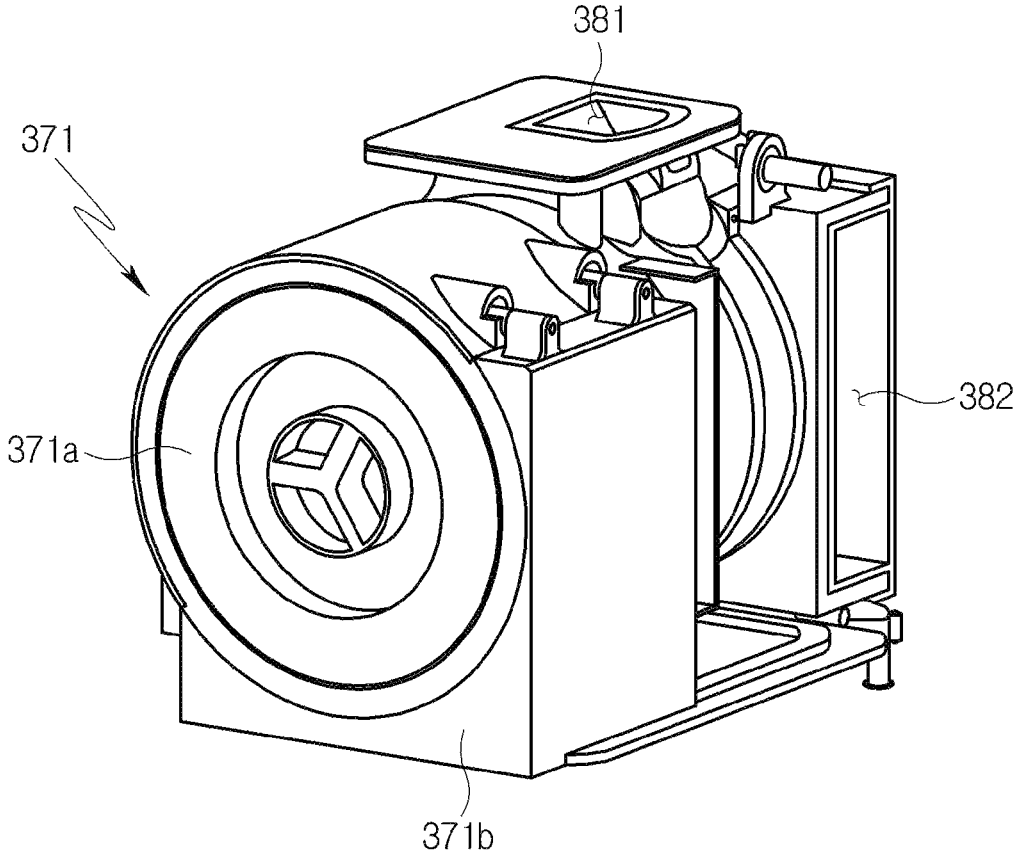
FIG. 15 is a perspective view for explaining a dust separating part in the cleaner station according to the embodiment of the present disclosure.
Figure 16:
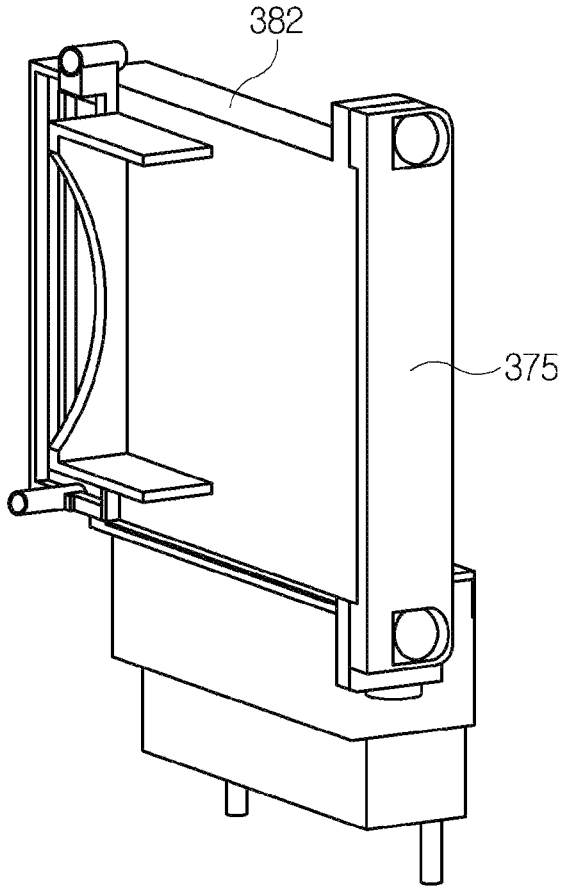
FIGS. 16 and 17 are perspective views for explaining a bag support part and the flow path part in the cleaner station according to the embodiment of the present disclosure.
Figure 17:
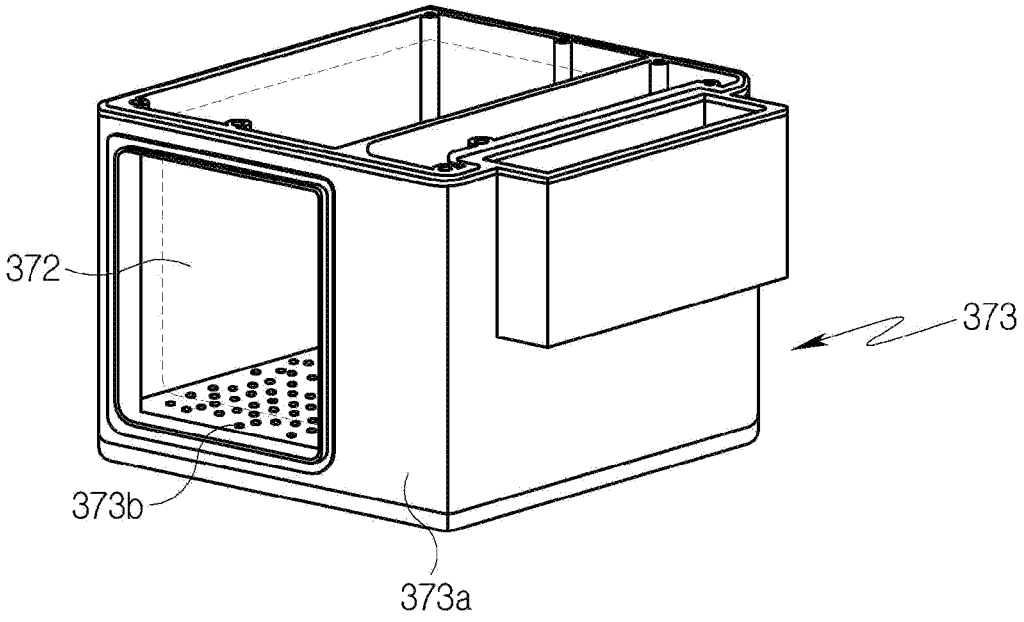

Meanwhile, FIG. 13 is a front view for explaining the dust collecting part in the cleaner station according to the embodiment of the present disclosure, FIG. 14 is a view for explaining a specific arrangement and configuration of the dust collecting part in FIG. 13, FIG. 15 is a perspective view for explaining the dust separating part in the cleaner station according to the embodiment of the present disclosure, and FIGS. 16 and 17 are perspective views for explaining the bag support part and the flow path part in the cleaner station according to the embodiment of the present disclosure.

Meanwhile, the dust collecting part 370 will be described below with reference to FIGS. 12 to 17 and 19 to 22.

The cleaner station 300 may include the dust collecting part 370. The dust collecting part 370 may be disposed in the housing 310. The dust collecting part 370 may be disposed in the bag accommodation space 315. The dust collecting part 370 may be disposed at the lower side of the coupling part 320 based on the gravitational direction. Further, the dust collecting part 370 may be disposed above the dust collecting motor 391 based on the gravitational direction. The specific arrangement of the dust collecting part 370 will be described below.

The dust collecting part 370 may capture the dust in the dust bin 220 of the cleaner 200. Specifically, when the dust collecting motor 391 operates in the state in which the cleaner 200 is coupled to the cleaner station 300 and the inside of the dust bin 220 communicates with the flow path part 380, the dust in the dust bin 220 may flow along the flow path part 380 and be captured in the dust collecting part 370.

The dust collecting part 370 may include a dust separating part 371, the dust bag 372, the bag support part 373, the dust bag cartridge 374, a prefilter 375, and the joining device 376.

The dust separating part 371 may separate dust from the air introduced from the dust bin 220.

The dust separating part 371 may be disposed above the dust bag 372, the bag support part 373, the dust bag cartridge 374, and the joining device 376. The dust separating part 371 may be disposed on the longitudinal axis C of the cleaner station 300.

The dust separating part 371 may communicate with the first flow path 381. The dust separating part 371 may separate the dust sucked through the first flow path 381. A space in the dust separating part 371 may communicate with a space in the bag support part 373.

For example, the dust separating part 371 may have one or more cyclone parts 371*a* capable of separating dust by using a cyclone flow. Therefore, air and dust, which are introduced through the first flow path 381, spirally flow along an inner circumferential surface of the dust separating part 371. Therefore, the cyclone flow may be generated in an internal space of the dust separating part 371.

Meanwhile, in the present embodiment, the cyclone part 371*a* may have a cylindrical mesh. In this case, an axial direction of the mesh may be disposed in parallel with the ground surface. With this configuration, when the cyclone part 371*a* is pulled from the lateral side of the cleaner station 300, the cyclone part 371*a* may be separated from the dust collecting part 370. Therefore, according to the present embodiment, the user may easily separate the cyclone part 371*a* and wash the mesh.

In addition, the dust separating part 371 may include a dust passage tube 371*b* configured to guide the dust, which is separated by the cyclone part 371*a*, to the dust bag 372. The dust passage tube 371*b* may be formed to be directed downward from one side of the cyclone part 371*a* based on the axial direction. Therefore, the dust passage tube 371*b* may allow the internal space of the bag support part 373 and the cyclone part 371*a* to communicate with each other.

The dust separating part 371 may further include a secondary cyclone part configured to separate again dust from the air discharged from the cyclone part. In this case, the secondary cyclone part may be positioned in the cyclone part to minimize a size of the dust separating part 371. The secondary cyclone part may include a plurality of cyclone bodies disposed in parallel. The air discharged from the cyclone part may be distributed to and pass through the plurality of cyclone bodies.

The dust separating part 371 communicates with the first flow path 381. The dust separating part 371 adopts a principle of a dust collector using a centrifugal force to separate the dust introduced into the housing 310 through the dust passage hole 321*a*.

The dust bag 372 may be disposed in the housing 310. The dust bag 372 may be disposed below the dust separating part 371 based on the gravitational direction.

The dust bag 372 may be made of an impermeable material. For example, the dust bag 372 may include a roll vinyl film (not illustrated). With this configuration, the dust bag 372 is sealed or joined, which may prevent dust or offensive odor captured in the dust bag 372 from leaking to the outside from the dust bag 372.

The dust bag 372 may be mounted in the housing 310 by means of the dust bag cartridge 374. As necessary, the dust bag 372 may be replaced by means of the dust bag cartridge 374. That is, the dust collecting part 370 may be defined as a consumable component. A volume of the dust bag 372 may be increased by the suction force (negative pressure), which is generated when the dust collecting motor 391 operates, in the state in which the dust bag 372 is mounted in the housing 310.

In this case, the dust bag 372 in the spread state may be accommodated in the bag support part 373. That is, the dust bag 372 may expand in the bag support part 373 when the dust collecting motor 391 operates. Further, the dust bag 372 in the spread state is supported by the bag support part 373, such that a shape of the dust bag 372 may be maintained.

The dust bag 372 may store the dust separated by the dust separating part 371. An upper region of the dust bag 372 may be cut and joined by the joining device 376. In the state in which the upper region of the dust bag 372 is cut and joined, the dust bag 372 may be separated from the bag support part 373.

With this configuration, the user need not separately tie a bag in which dust is captured, such that the user convenience may be improved.

The bag support part 373 may support the dust bag 372. In case that the dust bag 372 expands, the bag support part 373 may accommodate the dust bag 372 therein. The bag support part 373 may support an external shape of the expanded dust bag 372.

The bag support part 373 may be disposed below the dust separating part 371. With this configuration, the dust separated by the dust separating part 371 may be captured in the bag support part 373.

The bag support part 373 may be disposed below the dust bag cartridge 374. With this configuration, when the dust bag 372 expands downward from the dust bag cartridge 374, at least a part of the dust bag 372 may be accommodated in the bag support part 373.

The bag support part 373 may be disposed below the joining device 376. With this configuration, the expanded dust bag 372 may be joined by the joining device 376, the dust bag 372 may be separated, and then the dust bag 372 may be dropped downward by gravity and accommodated in the bag support part 373.

Specifically, the bag support part 373 may include a support part main body 373*a* and suction holes 373*b*.

The support part main body 373*a* may be separably coupled in the housing 310. For example, the support part main body 373*a* may be formed in a cylindrical shape, and wheels 373*c* may be provided at a lower side of the support part main body 373*a*. In this case, an outer peripheral surface of the support part main body 373*a* may be disposed to be spaced apart from a sidewall of the bag accommodation space 315. Therefore, a space may be defined between an outer peripheral surface of the support part main body 373*a* and the sidewall of the bag accommodation space 315. Further, a space may be defined between a lower surface of the support part main body 373*a* and a lower surface of the bag accommodation space 315. The space may provide a route along which a suction force of the dust collecting motor 391 is transmitted.

With this configuration, when the dust collecting motor 391 operates, the air, which is present in the bag accommodation space 315, may be sucked into the dust collecting motor 391 by the suction force of the dust collecting motor 391, and a negative pressure, which expands the dust bag 372, may be generated in the bag accommodation space 315.

The support part main body 373*a* may be formed to accommodate the dust bag 372 therein in case that the dust bag 372 expands. For example, the support part main body 373*a* may be formed in a cylindrical shape, an upper side of the support part main body 373*a* may be opened, and at least a part of the lower surface of the support part main body 373*a* may be closed.

As another example, the support part main body 373*a* may be formed in a hexahedral shape, and an upper side of the support part main body 373*a* may be opened, and a front side of the support part main body 373*a* may be opened. With this configuration, the dust bag 372 may be removed through the opened front side.

At least a part of the dust bag 372 may be disposed at an upper side of the support part main body 373*a*. Further, in case that the dust bag 372 expands, the dust bag 372 may expand downward and fill an internal space of the support part main body 373*a*.

The suction holes 373*b* may be provided as a plurality of suction holes 373*b* formed in the support part main body 373*a*. For example, the plurality of suction holes 373*b* may be formed along the outer peripheral surface of the support part main body 373*a*. Further, one or more suction holes 373*b* may be formed in the lower surface of the support part main body 373*a*. With this configuration, when the dust collecting motor 391 operates, the air in the support part main body 373*a* may flow to the outside of the support part main body 373*a* through the suction holes 373*b*. In addition, in the state in which the dust bag 372 is expanded in the support part main body 373*a*, the negative pressure may be applied to the dust bag 372 toward the outside of the support part main body 373*a*, and the dust bag 372 may expand to come into close contact with the inner peripheral surface and the lower surface of the support part main body 373*a*. That is, the dust bag 372 may expand along an internal shape of the bag support part 373.

In particular, when the plurality of suction holes 373*b* is formed while maintaining predetermined intervals, a uniform negative pressure is applied to the entire dust bag 372, such that the dust bag 372 may be uniformly expanded, and the expanded state may be maintained.

Meanwhile, the bag support part 373 may be provided in the housing 310 and configured to be withdrawn from the housing 310.

Figure 22:
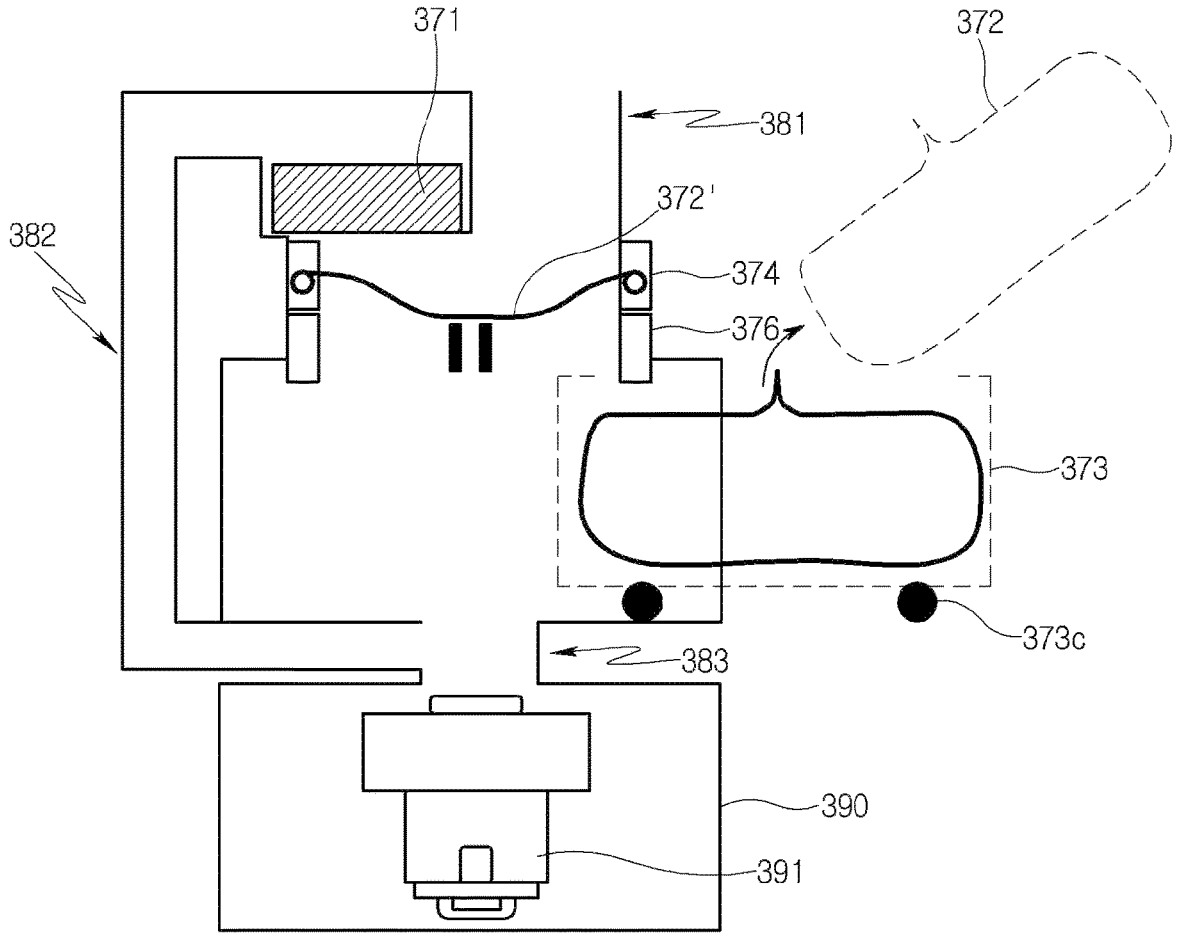

Specifically, the bag support part 373 may be provided in the bag accommodation space 315 formed in the housing 310. In this case, the bag support part 373 may have a structure for guiding the rectilinear movement of the bag support part 373. For example, as illustrated in FIG. 22, the plurality of wheels 373*c* may be provided on the bag support part 373. That is, the plurality of wheels 373*c* may be provided on the lower surface of the support part main body 373*a*. As another example, although not illustrated, a guide rail may be provided at a lateral side of the bag support part 373.

With this configuration, the user may withdraw the dust bag 372 to the outside of the housing 310 by pulling the bag support part 373 after opening a lateral door (not illustrated) of the cleaner station 300. Therefore, according to the present disclosure, the user may easily withdraw and discard the dust bag.

The dust bag cartridge 374 may be separably coupled to the housing 310 and supply the dust bag 372.

The dust bag cartridge 374 may be detachably coupled to the housing 310. Although not illustrated, a structure to which the dust bag cartridge 374 is coupled may be provided in the housing 310 (the bag accommodation space 315), and the user may insert the dust bag cartridge 374 into the housing 310. In addition, when the user pulls the dust bag cartridge 374 to the outside of the cleaner station 300 in the state in which the dust bag cartridge 374 is coupled to the housing 310, the dust bag cartridge 374 may be separated from the housing 310. With this configuration, the user may easily mount or separate the dust bag cartridge 374 in or from the housing.

The dust bag 372 may be provided in the dust bag cartridge 374. For example, at least a part of the dust bag 372, which is provided in the form of a roll vinyl film, may be coupled to the dust bag cartridge 374. The dust bag 372 may be expanded in the direction toward the bag support part 373 by the operation of the dust collecting motor 391. In addition, when the joining device 376 to be described below operates, the dust bag 372 may be joined, and a part of the dust bag 372 may be separated from the dust bag cartridge 374. With this configuration, the user need not separately tie a bag in which dust is captured, such that the user convenience may be improved.

The dust bag cartridge 374 may be disposed below the dust separating part 371. For example, an upper surface of the dust bag cartridge 374 may be in contact with a lower surface of the dust separating part 371. In this case, a sealer may be provided on the upper surface of the dust bag cartridge 374 and/or the lower surface of the dust separating part 371 and prevent a leak of debris. With this configuration, the debris separated by the dust separating part 371 may be captured in the dust bag 372 without leaking to the outside.

The dust bag cartridge 374 may be disposed above the joining device 376. For example, a lower surface of the dust bag cartridge 374 and an upper surface of the joining device 376 may be in contact with each other. In this case, a sealer may be provided on the lower surface of the dust bag cartridge 374 and/or the upper surface of the joining device 376 and prevent a leak of debris. With this configuration, it is possible to prevent the debris on the flow path part 380 from leaking between the dust bag cartridge 374 and the joining device 376 in the state in which the dust bag 372 is joined and separated.

The dust collecting part 370 may further include the prefilter 375. The prefilter 375 may be disposed on the second flow path 382 and separate the debris from the air flowing along the second flow path 382. For example, the prefilter 375 may be disposed at an inlet port side of the second flow path 382 and separate the dust contained in the air having passed through the dust separating part 371. With this configuration, it is possible to prevent the debris from being introduced into the dust collecting motor 391.

The prefilter 375 may be detachably coupled to the second flow path 382. The prefilter 375 may be disposed at the front side of the cleaner station 300 and detachably coupled to the second flow path 382.

The dust collecting part 370 may further include the joining device 376. The joining device 376 may be disposed in the housing 310. For example, the joining device 376 may be fixedly coupled to the housing 310.

The joining device 376 may be disposed below the dust bag cartridge 374. For example, the upper surface of the joining device 376 may be in contact with the lower surface of the dust bag cartridge 374. With this configuration, the joining device 376 may guide the attachment or detachment of the dust bag cartridge 374. Meanwhile, a sealer may be provided between the upper surface of the joining device 376 and the lower surface of the dust bag cartridge 374 and prevent a leak of debris.

The joining device 376 may be disposed above the bag support part 373. For example, a lower surface of the joining device 376 may be in contact with an upper surface of the bag support part 373. In this case, a sealer may be provided between the lower surface of the joining device 376 and the upper surface of the bag support part 373 and prevent a leak of debris.

The joining device 376 may cut and join an upper region of the dust bag 372 in which dust is captured. Specifically, the joining device 376 may retract the dust bag 372 to a central region and join the upper region of the dust bag 372 by using a heating wire. For example, the joining device 376 may include a first joining member (not illustrated) and a second joining member (not illustrated). The first joining member (not illustrated) may be moved in a first direction by a first joining drive part, and the second joining member (not illustrated) may be moved in a second direction perpendicular to the first direction by a second joining drive part.

With this configuration, the dust captured from the outside may be collected in the roll vinyl film, and the roll vinyl film may be automatically joined. Therefore, it is not necessary for the user to separately tie a bag in which the dust is captured, and as a result, it is possible to improve convenience for the user.

Meanwhile, although not illustrated, the dust collecting part 370 may include a dust amount sensor. The dust amount sensor may measure the amount of dust in the dust bag 372.

The cleaner station 300 may include the flow path part 380. The flow path part 380 may connect the cleaner 200, the dust collecting part 370, and the dust collecting motor 391.

The flow path part 380 may include the first flow path 381, the second flow path 382, and the bypass flow path 383.

The first flow path 381 may connect the dust bin 220 of the cleaner 200 and the dust collecting part 370. The first flow path 381 may be disposed at a rear side of the coupling surface 321. The first flow path 381 may mean a space between the dust bin 220 of the cleaner 200 and the dust collecting part 370. The first flow path 381 may be a space formed at a rear side of the dust passage hole 321*a*. The first flow path 381 may be a flow path directed downward from the dust passage hole 321*a*, and the dust and the air may flow through the first flow path 381.

For example, the first flow path 381 may include a first region 381*a* configured to communicate with the internal space of the dust bin 220 when the cleaner 200 is coupled to the cleaner station 300 and the dust passage hole 321*a* is opened, and a second region 381*b* configured to allow the first region 381*a* and the bag accommodation space 315 (or the internal space of the dust collecting part 370) to communicate with each other. In this case, a direction in which the first region 381*a* is formed may be disposed substantially in parallel with the axial direction (longitudinal direction) of the dust bin. In addition, a direction in which the second region 381*b* is formed may be disposed in parallel with the longitudinal axis C of the housing 310. In this case, the first region 381*a* may be formed to have a predetermined angle with respect to the second region 381*b*. With this configuration, it is possible to minimize a decrease in suction force of the dust collecting motor 391 in the first flow path 381 and the second flow path 382.

Therefore, when the dust collecting motor 391 operates, the dust in the dust bin 220 of the cleaner 200 may flow to the dust collecting part 370 through the first flow path 381.

The second flow path 382 may connect the dust collecting part 370 and the dust suction module 390. Specifically, the second flow path 382 may be a flow path that connects the upper side of the dust collecting part 370 and the upper side of the dust suction module 390. For example, the second flow path 382 may include a third region 382*a* formed vertically upward from the upper side of the dust collecting part 370, a fourth region 382*b* connected to the third region 382*a* and formed horizontally, a fifth region 382*c* connected to the fourth region 382*b* and formed vertically downward, and a sixth region 382*d* formed horizontally from the fifth region 382*c* and merged with the bypass flow path 383.

With this configuration, it is possible to guide the air, which has passed through the dust collecting part 370, to the dust collecting motor 391 through the second flow path 382.

The bypass flow path 383 may connect the bag support part 373 and the dust collecting motor 391 by means of the flow path.

The bypass flow path 383 may allow the bag accommodation space 315 and the internal space of the dust suction module 390 to communicate with each other. For example, the bypass flow path 383 may be a flow path formed in the gravitational direction to connect the bag accommodation space 315 and the dust suction module 390. With this configuration, the bypass flow path 383 may guide the air, which is present in the bag accommodation space 315, to the dust collecting motor 391.

The second flow path 382 and the bypass flow path 383 may communicate with each other and be connected to the dust suction module 390. For example, the second flow path 382 may be connected to the bypass flow path 383, and the bypass flow path 383 may be connected to the dust suction module 390. As another example, the bypass flow path 383 may be connected to the second flow path 382, and the second flow path 382 may be connected to the dust suction module 390. Therefore, the second flow path 382 and the bypass flow path 383 may be respectively connected to the dust collecting part 370 and the dust collecting motor 391 by means of the flow paths.

With this configuration, the operation of the dust collecting motor 391 may simultaneously maintain the shape of the dust bag and suck outside air.

The cleaner station 300 may include the dust suction module 390. The dust suction module 390 may include the dust collecting motor 391.

The dust collecting motor 391 may be disposed below the dust collecting part 370. The dust collecting motor 391 may generate a suction force in the flow path part 380. Therefore, the dust collecting motor 391 may provide a suction force capable of sucking the dust in the dust bin 220 of the cleaner 200.

The dust collecting motor 391 may generate the suction force by means of the rotation. For example, the dust collecting motor 391 may be formed in a shape similar to a cylindrical shape and generate a suction force while rotating about a rotation axis. In this case, a direction of the rotation axis of the dust collecting motor 391 may be disposed to be perpendicular to the ground surface.

Figure 18:
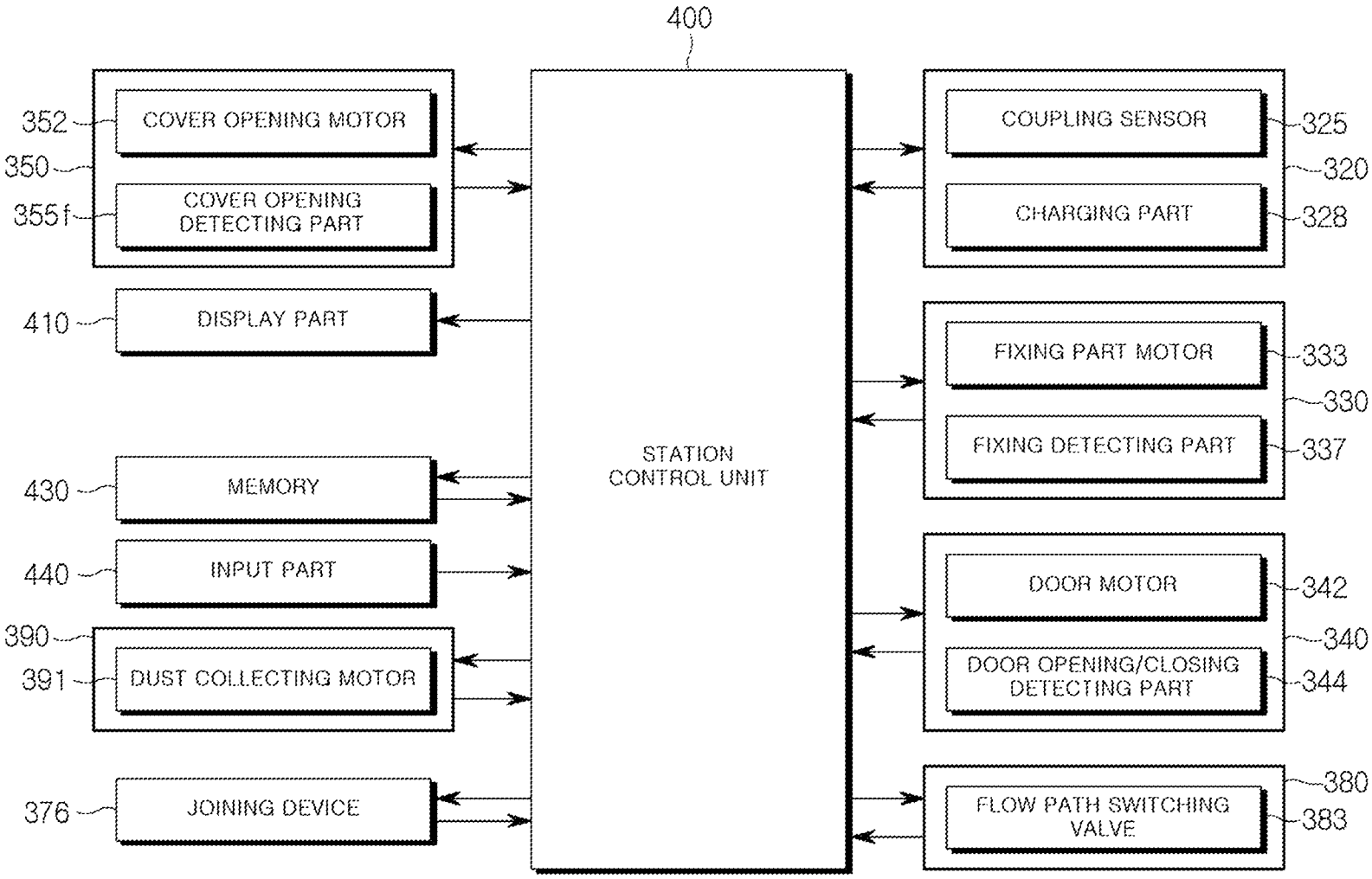
FIG. 18 is a block diagram for explaining a control configuration in the cleaner station according to the embodiment of the present disclosure.
Figure 19:
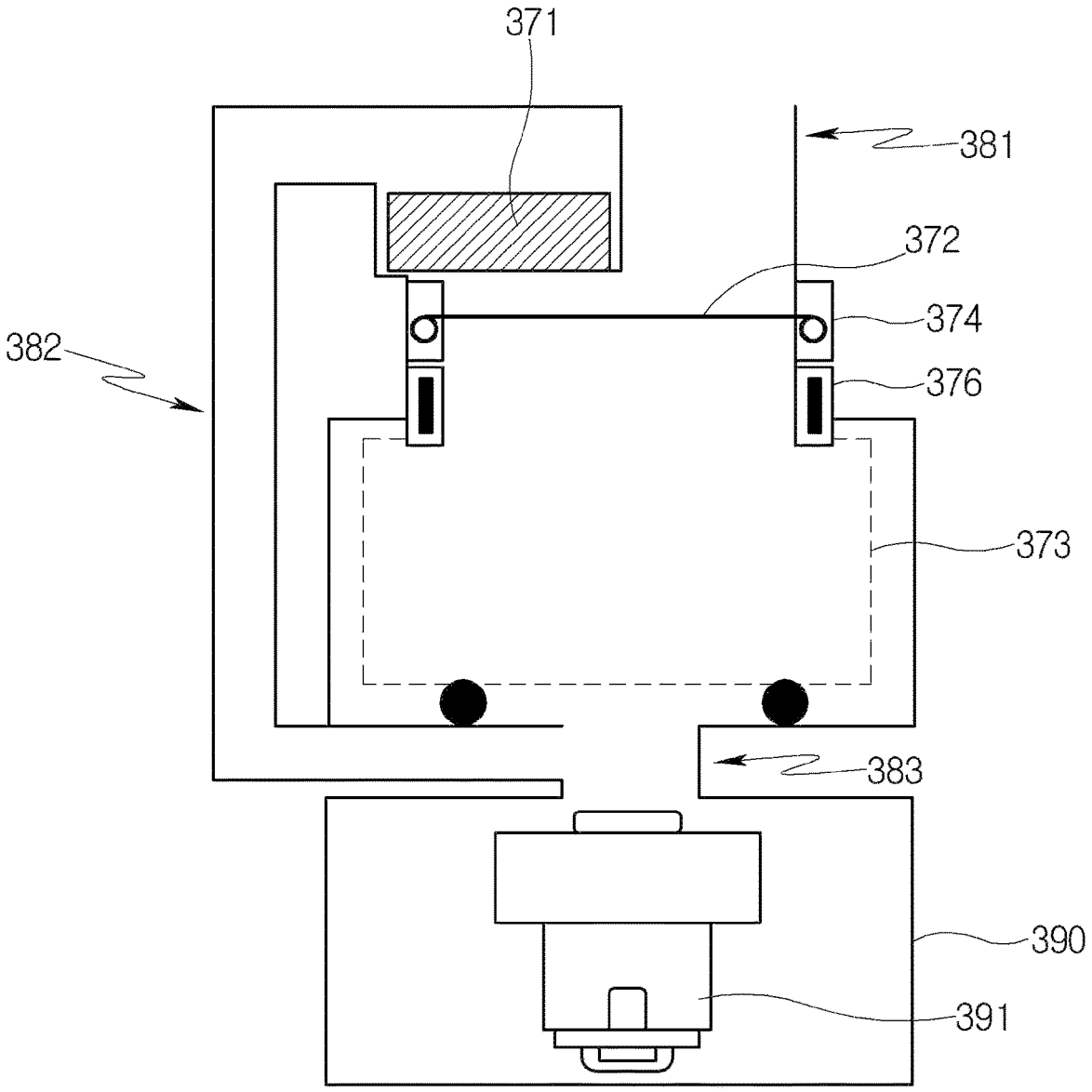
FIGS. 19 to 22 are views for explaining a process of expanding a dust bag and joining and removing the dust bag in the cleaner station according to the embodiment of the present disclosure.
Figure 20:
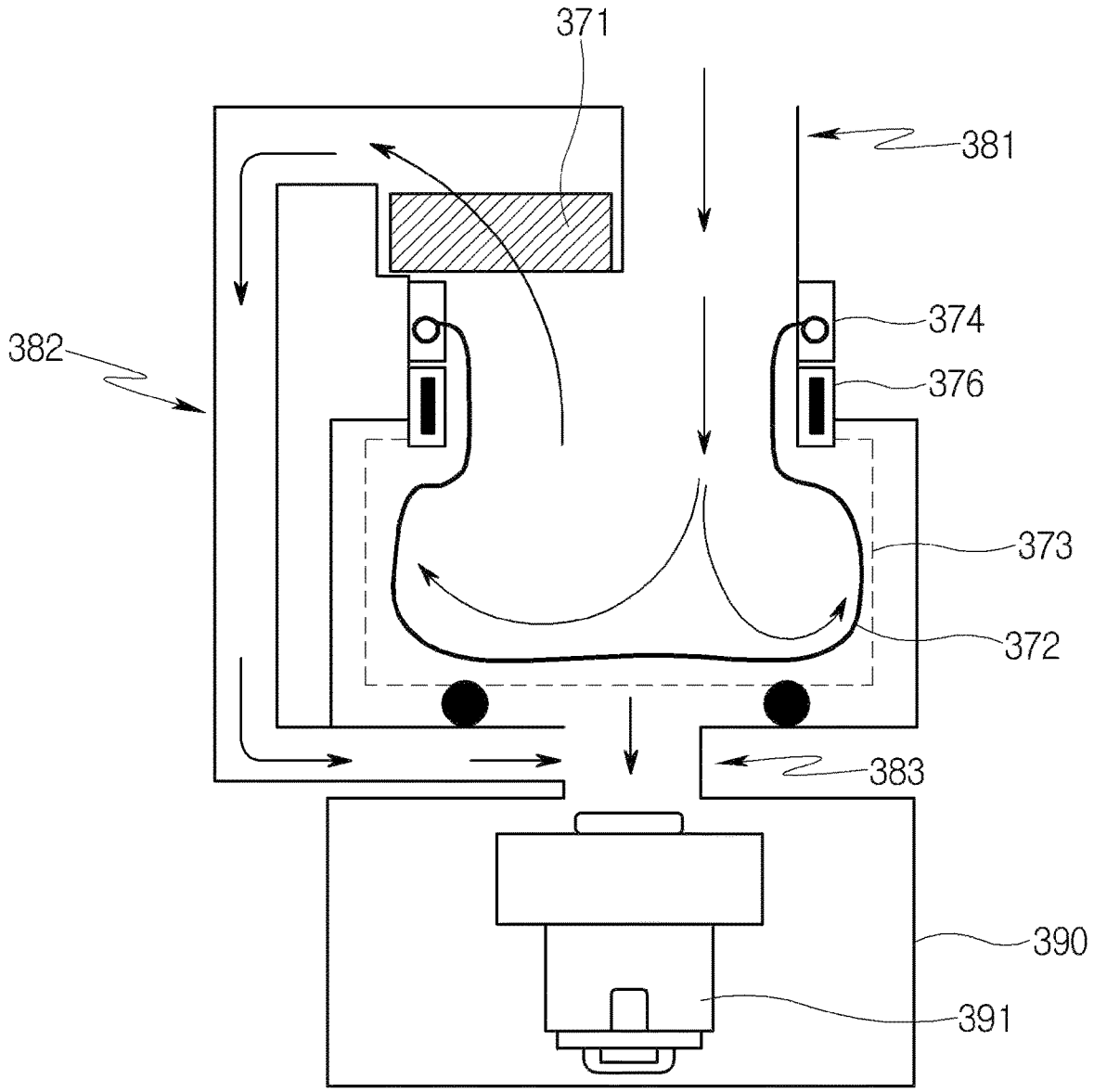
Figure 21:
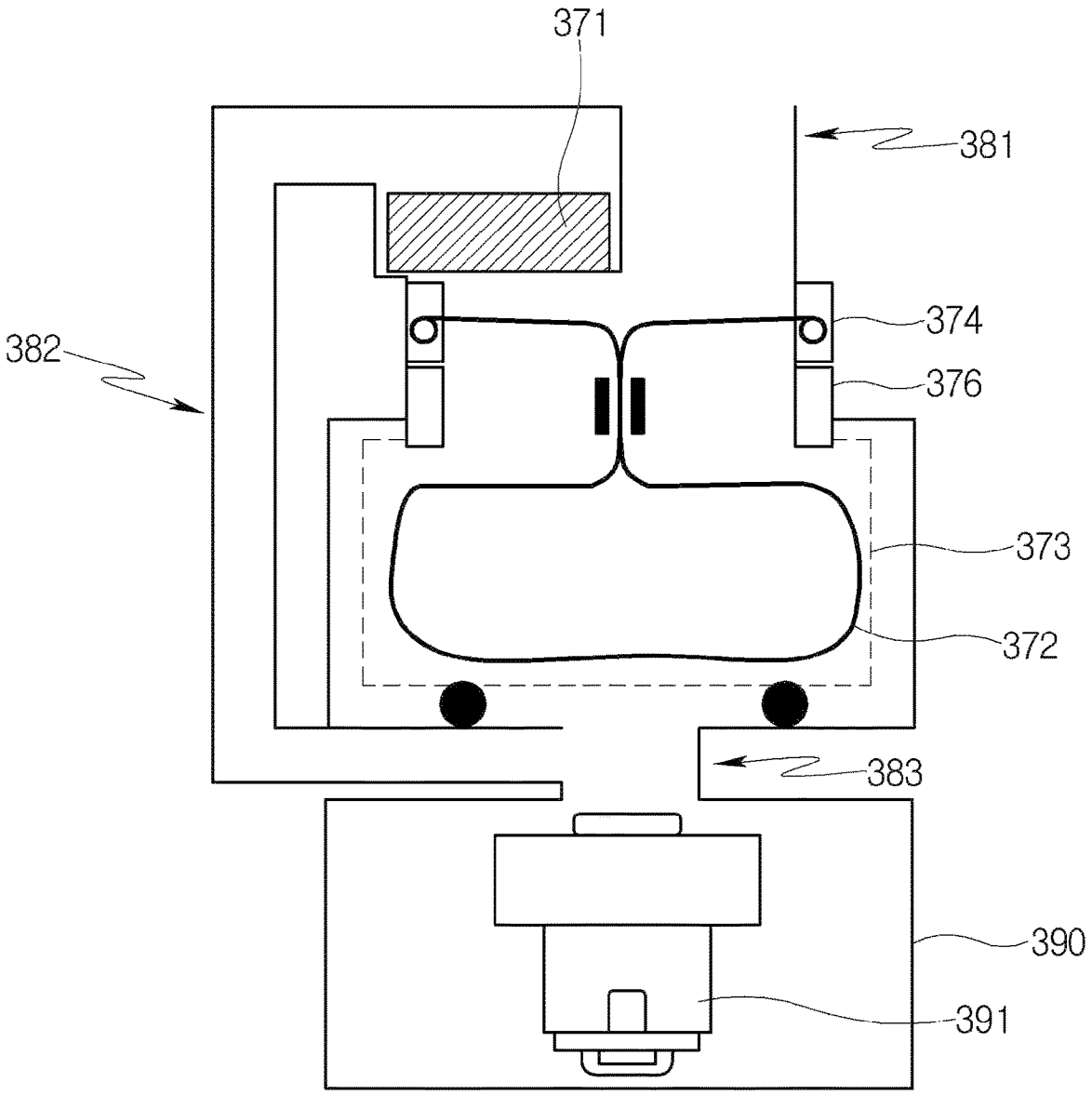

Meanwhile, FIG. 18 is a block diagram for explaining a control configuration of the cleaner station according to the embodiment of the present disclosure.

The control configuration of the cleaner station 300 of the present disclosure will be described below with reference to FIG. 18.

The cleaner station 300 according to the embodiment of the present disclosure may further include a station control unit 400 configured to control the coupling part 320, the fixing unit 330, the door unit 340, the cover opening unit 350, the dust collecting part 370, the flow path part 380, and the dust suction module 390.

The station control unit 400 may include a printed circuit board and elements mounted on the printed circuit board.

When the coupling sensor 325 detects the coupling of the cleaner 200, the coupling sensor 325 may transmit a signal indicating that the cleaner 200 is coupled to the coupling part 320. In this case, the station control unit 400 may receive the signal from the coupling sensor 325 and determine that the cleaner 200 is coupled to the coupling part 320.

In addition, when the charging part 328 supplies power to the battery 240 of the cleaner 200, the station control unit 400 may determine that the cleaner 200 is coupled to the coupling part 320.

When the station control unit 400 determines that the cleaner 200 is coupled to the coupling part 320, the station control unit 400 may operate the fixing part motor 333 to fix the cleaner 200.

When the fixing members 331 or the fixing part links 335 are moved to a predetermined fixing point FP1, a fixing detecting part 337 may transmit a signal indicating that the cleaner 200 is fixed. The station control unit 400 may receive the signal, which indicates that the cleaner 200 is fixed, from the fixing detecting part 337, and determine that the cleaner 200 is fixed. When the station control unit 400 determines that the cleaner 200 is fixed, the station control unit 400 may stop the operation of the fixing part motor 333.

Meanwhile, when the operation of emptying the dust bin 220 is ended, the station control unit 400 may rotate the fixing part motor 333 in the reverse direction to release the cleaner 200.

When the station control unit 400 determines that the cleaner 200 is fixed to the coupling part 320, the station control unit 400 may operate the door motor 342 to open the door 341 of the cleaner station 300.

When the door 341 or the door arm 343 reaches the predetermined opening position DP1, the door opening/closing detecting part 344 may transmit a signal indicating that the door 341 is opened. The station control unit 400 may receive the signal, which indicates that the door 341 is opened, from the door opening/closing detecting part 337 and determine that the door 341 is opened. When the station control unit 400 determines that the door 341 is opened, the station control unit 400 may stop the operation of the door motor 342.

Meanwhile, when the operation of emptying the dust bin 220 is ended, the station control unit 400 may rotate the door motor 342 in the reverse direction to close the door 341.

When the station control unit 400 determines that the door 341 is opened, the station control unit 400 may operate the cover opening motor 352 to open the discharge cover 222 of the cleaner 200.

When the guide frame 351*e* reaches the predetermined opened position CP1, the cover opening detecting part 355*f* may transmit a signal indicating that the discharge cover 222 is opened. The station control unit 400 may receive the signal, which indicates that the discharge cover 222 is opened, from the cover opening detecting part 355*f* and determine that the discharge cover 222 is opened. When the station control unit 400 determines that the discharge cover 222 is opened, the station control unit 400 may stop the operation of the cover opening motor 352.

The station control unit 400 may operate the joining device 376 to join the dust bag 372. For example, the station control unit 400 may operate and move the first joining member in the first direction, and the station control unit 400 may operate and move the second joining member in the second direction perpendicular to the first direction.

Meanwhile, in the present embodiment, the station control unit 400 may operate the joining device 376 after the operation of the dust collecting motor 391 is ended. For example, the station control unit 400 may operate the joining device 376 when a preset predetermined time elapses after the operation of the dust collecting motor 391 is ended. As another example, the station control unit 400 may operate the joining device 376 when a predetermined time elapses after the dust collecting motor 391 operates a preset number of times. As still another example, the station control unit 400 may operate the joining device 376 for each preset cycle. In case that the dust collecting motor 391 is operating, the station control unit 400 may operate the joining device 376 when a predetermined time elapses. In addition, the station control unit 400 may operate the joining device 376 when the amount of dust measured by the dust amount sensor (not illustrated) exceeds a predetermined reference.

With this configuration, it is possible to improve hygiene by sealing the dust bag 372 in a state in which the dust is settled in the dust bag 372 without floating in the cleaner station 300.

The station control unit 400 may operate the dust collecting motor 391 to suck the dust in the dust bin 220.

The station control unit 400 may operate a display part 410 to display a dust bin emptied situation and a charged situation of the cleaner 200. For example, in the present embodiment, in case that the amount of dust measured by the dust amount sensor exceeds a predetermined reference value, the station control unit 400 may display information, which indicates that the dust bag 372 is required to be replaced, on the display part 410.

Meanwhile, the cleaner station 300 according to the present disclosure may include the display part 410.

The display part 410 may be disposed on the housing 310, disposed on a separate display device, or disposed on a terminal such as a mobile phone.

The display part 410 may be configured to include at least any one of a display panel capable of outputting letters and/or figures and a speaker capable of outputting voice signals and sound. The user may easily ascertain a situation of a currently performed process, a residual time, and the like on the basis of information outputted through the display part.

Meanwhile, the cleaner station 300 according to the embodiment of the present disclosure may include a memory 430. The memory 430 may include various data for operating or driving the cleaner station 300.

Meanwhile, the cleaner station 300 according to the embodiment of the present disclosure may include an input part 440. The input part 440 generates key input data inputted by the user to control the operation of the cleaner station 300. To this end, the input part 440 may include a keypad, a dome switch, a touchpad (resistive touchpad/capacitive touchpad), and the like. In particular, in case that the touchpad defines a mutual layer structure together with the display part 410, the touchpad may be called a touch screen.

A process of operating the cleaner system 3 according to the embodiment of the present disclosure will be described below with reference to FIGS. 12 and 18 to 22.

First, when the cleaner 200 is coupled to the cleaner station 300, the fixing part motor 333 may operate, and the fixing member 331 may move to fix the dust bin 220 of the cleaner 200.

Further, when the dust bin 220 of the cleaner 200 is fixed, the cover opening motor 352 may operate, the discharge cover 222 of the cleaner 200 may be opened, and the door motor 342 may operate, such that the door 341 may open the dust passage hole 321*a*. In this case, the inside of the dust bin 220, the first flow path 381, and the dust collecting part 370 may communicate with one another.

Next, when the dust collecting motor 391 operates, a negative pressure may be applied to the flow path part 380, and the air and dust in the dust bin 220 may flow toward the dust collecting motor 391.

Specifically, the air, which is introduced into the first flow path 381 from the inside of the dust bin 220, may pass through the first flow path 381, and then the dust may be separated by the dust separating part 371. Further, the air, from which the dust is separated, may flow toward the dust collecting motor 391 through the second flow path 382 and then be discharged to the outside.

Meanwhile, when the negative pressure is applied to the bypass flow path 383 as the dust collecting motor 391 operates, the dust bag 372 may expand toward the bag support part 373. Further, the dust separated from the air may be captured in the expanded dust bag 372 (see FIG. 20).

Next, when the dust collecting motor 391 is ended, the joining device 376 may operate. When the joining device 376 operates, the upper portions of the dust bag 372, which is expanded in the bag support part 373, may be joined to each other. Therefore, the dust bag 372 is sealed, such that the dust captured in the dust bag 372 is not discharged to the outside. Further, the joined dust bag 372 may be separated downward and accommodated in the bag support part 373 (see FIG. 21).

Meanwhile, as the dust bag 372 is separated, a new dust bag 372' may be created in the dust bag cartridge 374. For example, the new dust bag 372' may be created as the dust bag 372 is joined and separated from the roll vinyl film provided in the dust bag cartridge 374 (see FIG. 22).

Further, the bag support part 373 may move to the outside of the housing 310 of the cleaner station 300. For example, the plurality of wheels 373*c* may be provided on the lower surface of the bag support part 373. When the user opens the lateral door (not illustrated) of the housing 310 and pulls the bag support part 373, the bag support part 373 may be moved to the outside of the housing 310. In this state, the user may withdraw the sealed dust bag 372 and discard the dust bag 372.

With this configuration, it is possible to provide convenience in that the user may empty the dust bin only by performing a simple operation of withdrawing the dust bag, which is sealed in advance, from the cleaner station 300 and then discarding the dust bag.

Figure 23:
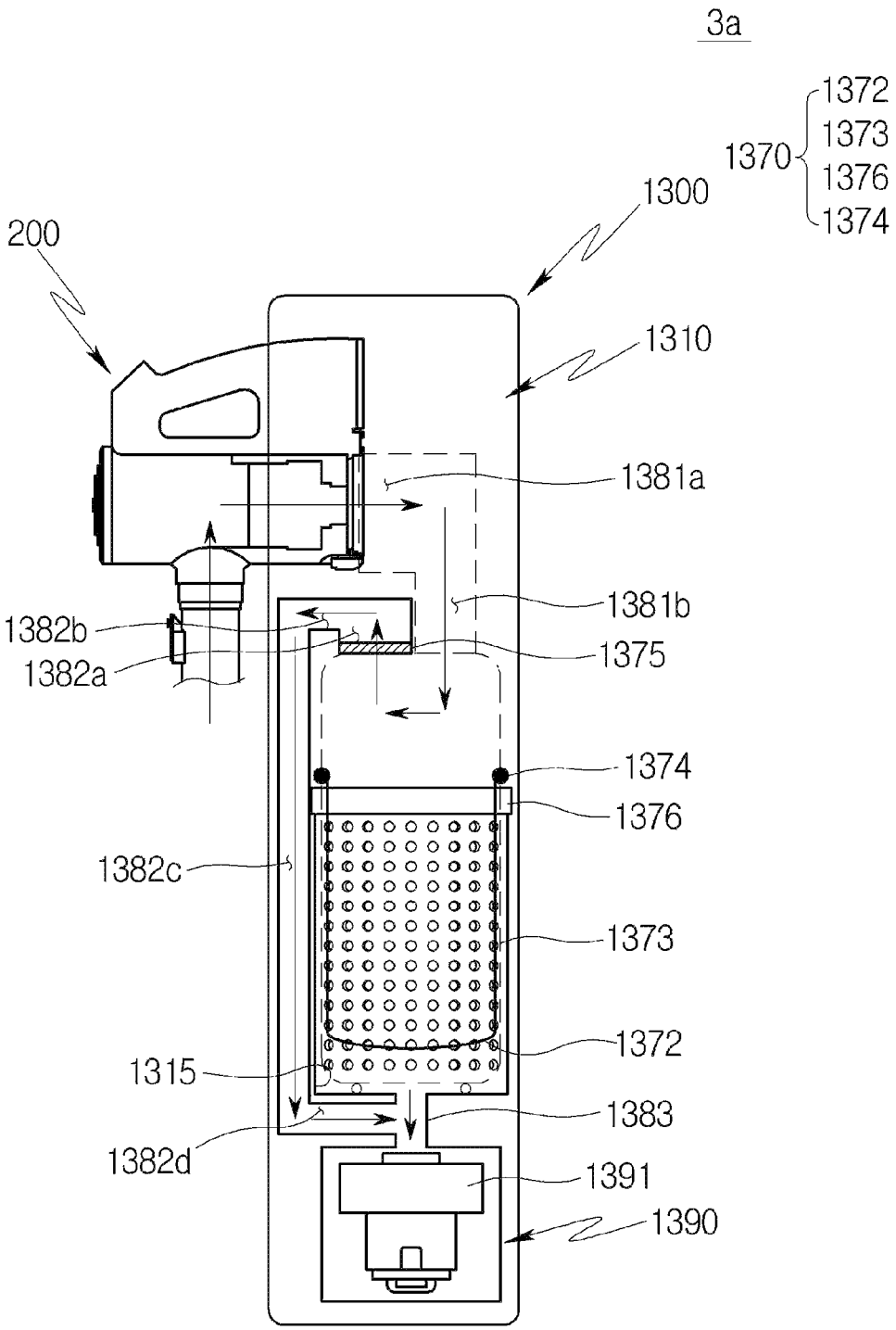
FIG. 23 is a view for explaining a cleaner system according to another embodiment of the present disclosure.

Meanwhile, FIG. 23 is a view for explaining a cleaner system according to another embodiment of the present disclosure.

In order to avoid the repeated description, the description of the cleaner system according to the embodiment of the present disclosure may be applied, except for components particularly described in the present embodiment.

A cleaner system 3*a* according to another embodiment of the present disclosure will be described below with reference to FIG. 23.

In the present embodiment, a prefilter 1375 may be disposed in an inlet port of a second flow path 1382 and separate the dust from the air introduced into the second flow path 1382. With this configuration, it is possible to prevent the debris from being introduced into a dust collecting motor 1391.

The prefilter 1375 may separate the dust from the air sucked into a dust collecting part 1370 through a first flow path 1381. The prefilter 1375 may be disposed above a dust bag 1372 based on the gravitational direction.

Meanwhile, in the present embodiment, the first flow path 1381 may include a first region 1381*a* configured to communicate with an internal space of the dust bin 220, and a second region 1381*b* configured to allow the first region 1381*a* and a bag accommodation space 1315 (or the internal space of the dust collecting part 1370) to communicate with each other. In this case, a direction in which the first region 1381*a* is formed may be disposed substantially in parallel with the axial direction (longitudinal direction) of the dust bin. In addition, a direction in which the second region 1381*b* is formed may be disposed in parallel with the longitudinal axis C of the housing 1310. In this case, the first region 1381*a* may be formed to have a predetermined angle with respect to the second region 1381*b*.

In addition, the second flow path 1382 may include a third region 1382*a* formed vertically upward from an upper side of the bag accommodation space 1315 (or an upper side of the dust collecting part 1370), a fourth region 1382*b* connected to the third region 1382*a* and formed horizontally, a fifth region 1382*c* connected to the fourth region 1382*b* and formed vertically downward, and a sixth region 1382*d* formed horizontally from the fifth region 1382*c* and merged with a bypass flow path 1383.

Therefore, when the dust collecting motor 1391 operates, the air, which flows vertically downward along the second region 1381*a*, flows vertically upward along the third region 1382*a*. In this process, the dust, which is relatively heavy in weight, may be dropped into the dust bag 1372, and the dust, which is relatively light in weight, may be filtered out by the prefilter 1375 and separated from the air.

Therefore, in the present embodiment, the dust in the air may be separated only by the prefilter 1375, unlike the embodiment of the present disclosure in which both the dust separating part 371 and the prefilter 375 are provided.

Figure 24:
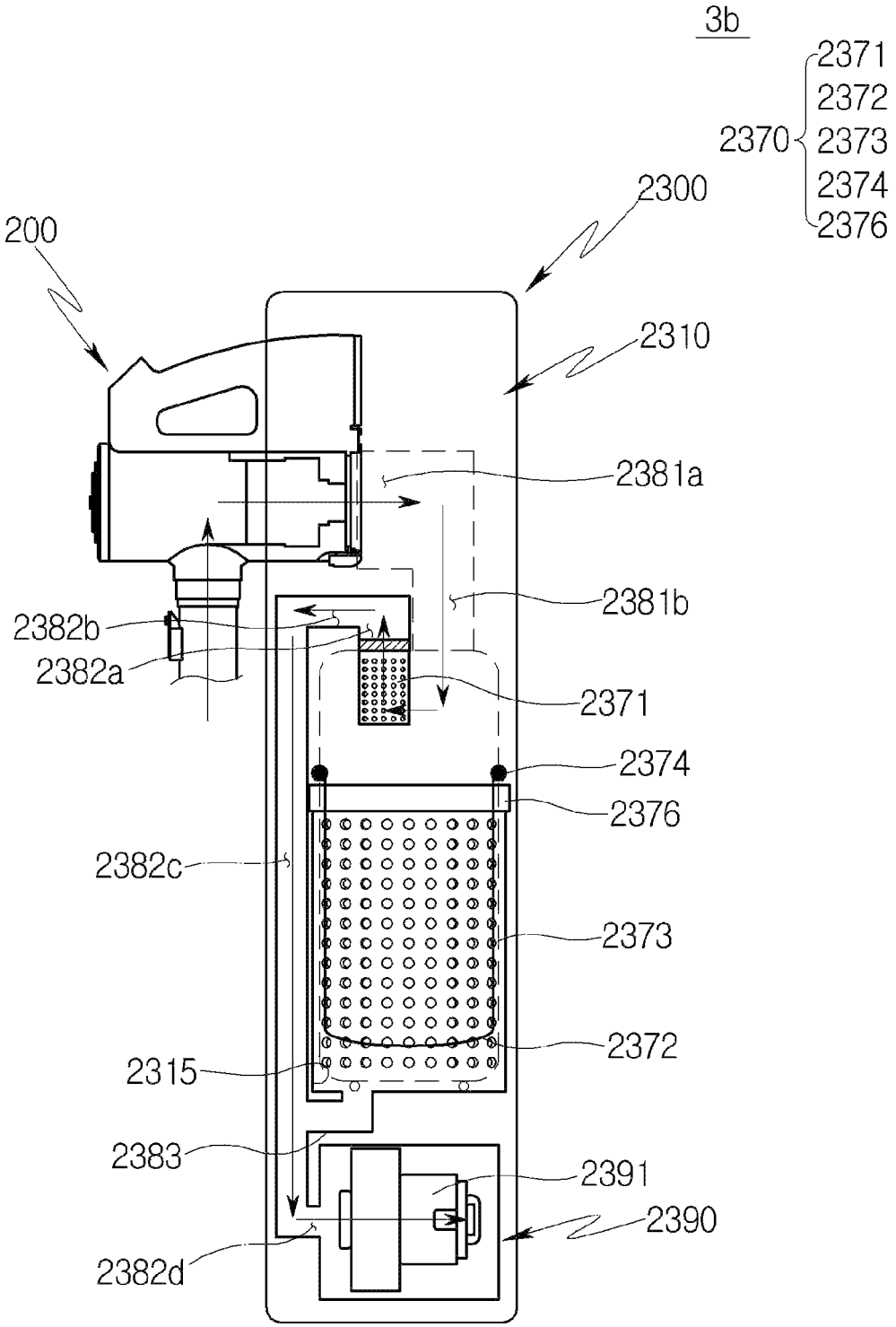
FIG. 24 is a view for explaining a cleaner system according to still another embodiment of the present disclosure.

Meanwhile, FIG. 24 is a view for explaining a cleaner system according to still another embodiment of the present disclosure.

In order to avoid the repeated description, the description of the cleaner system according to the embodiment of the present disclosure may be applied, except for components particularly described in the present embodiment.

A cleaner system 3*b* according to still another embodiment of the present disclosure will be described below with reference to FIG. 24.

In the present embodiment, the first flow path 2381 may include a first region 2381*a* configured to communicate with an internal space of the dust bin 220, and a second region 2381*b* configured to allow the first region 2381*a* and a bag accommodation space 2315 (or the internal space of the dust collecting part 2370) to communicate with each other. In this case, a direction in which the first region 2381*a* is formed may be disposed substantially in parallel with the axial direction (longitudinal direction) of the dust bin 220. In addition, a direction in which the second region 2381*b* is formed may be disposed in parallel with the longitudinal axis C of the housing 2310. In this case, the first region 2381*a* may be formed to have a predetermined angle with respect to the second region 2381*b*.

In addition, the second flow path 2382 may include a third region 2382*a* formed vertically upward from an upper side of the bag accommodation space 2315 (or an upper side of the dust collecting part 2370), a fourth region 2382*b* connected to the third region 2382*a* and formed horizontally, a fifth region 2382*c* connected to the fourth region 2382*b* and formed vertically downward, and a sixth region 2382*d* formed horizontally from the fifth region 2382*c* and connected to a dust suction module 2390.

In the present embodiment, a bypass flow path 2383 may connect a bag support part 2350 and a dust collecting motor 2391.

Specifically, the bypass flow path 2383 may guide the air in a bag accommodation space 2315 to a second flow path 2382. For example, the bypass flow path 2383 may be formed vertically downward from the inside of the bag accommodation space 2315 and then formed horizontally toward the fifth region 2382*c* of the second flow path 2382. As another example, the bypass flow path 2383 may be formed to be inclined downward toward the fifth region 2382*c* of the second flow path 2382 from the bag accommodation space 2315.

The second flow path 2382 and the bypass flow path 2383 may communicate with each other and be connected to the dust suction module 2390. For example, the bypass flow path 2383 may be connected to the second flow path 2382, and the second flow path 2382 may be connected to the dust suction module 2390. Therefore, the second flow path 2382 and the bypass flow path 2383 may be respectively connected to the dust collecting part 2370 and the dust collecting motor 2391 by means of the flow paths.

With this configuration, the air, which is present in the bag accommodation space 2315, may be merged with the second flow path 2382 and introduced into the dust collecting motor 2391.

Meanwhile, in the present embodiment, a direction of a rotation axis of the dust collecting motor 2391 may be disposed in parallel with the ground surface. In this case, a direction in which the sixth region 2382*d* of the second flow path 2382 is formed may be disposed substantially in parallel with the axial direction (longitudinal direction) of the dust collecting motor 2391. With this configuration, it is possible to simplify the route for the air flowing to the dust collecting motor 2391 while passing through the second flow path 2382 and minimize a degree to which the suction force of the dust collecting motor 2391 decreases in the second flow path 2382.

While the present disclosure has been described with reference to the specific embodiments, the specific embodiments are only for specifically explaining the present disclosure, and the present disclosure is not limited to the specific embodiments. It is apparent that the present disclosure may be modified or altered by those skilled in the art without departing from the technical spirit of the present disclosure.

All the simple modifications or alterations to the present disclosure fall within the scope of the present disclosure, and the specific protection scope of the present disclosure will be defined by the appended claims.

The invention claimed is:

1. A cleaner station comprising:

a housing, the housing comprising a coupling part that defines a coupling surface configured to couple to at least a part of a cleaner;

a dust collecting part accommodated in the housing and disposed at a lower side of the coupling part, the dust collecting part being configured to collect dust from a dust bin of the cleaner;

a dust collecting motor accommodated in the housing and disposed below the dust collecting part, the dust collecting motor configured to generate a suction force for suctioning the dust from the dust bin; and a plurality of flow paths comprising (i) a first flow path configured to connect the dust bin of the cleaner to the dust collecting part and (ii) a second flow path configured to guide air having passed through the dust collecting part to the dust collecting motor, wherein the dust collecting part comprises:

a dust separating part comprising at least one cyclone configured to separate dust from air received from the dust bin, and a bag support configured to accommodate a dust bag, the dust bag being configured to store the dust separated by the dust separating part, and wherein the plurality of flow paths further comprise a bypass flow path that connects the bag support to the dust collecting motor.

2. The cleaner station of claim 1, wherein the dust collecting part further comprises a dust bag cartridge separably coupled to the housing and configured to supply the dust bag.

3. The cleaner station of claim 1, wherein the dust collecting part further comprises a prefilter disposed in the second flow path and configured to separate debris from air in the second flow path.

4. The cleaner station of claim 1, wherein the dust collecting part further comprises a joining device configured to couple the dust bag to the bag support.

5. The cleaner station of claim 4, wherein the joining device is configured to operate based on a completion of an operation of the dust collecting motor.

6. The cleaner station of claim 1, wherein the bag support comprises:

a support part main body configured to accommodate the dust bag therein; and a wheel disposed at a lower surface of the support part main body.

7. The cleaner station of claim 1, wherein the housing defines a bag accommodation space that accommodates the bag support therein, and wherein the dust bag is configured to be accommodated in the bag support and to be discharged from the bag accommodation space.

8. The cleaner station of claim 1, wherein the housing defines a bag accommodation space configured to accommodate the bag support therein, and wherein the first flow path and the second flow path are connected to an upper side of the bag accommodation space.

9. The cleaner station of claim 8, wherein the bypass flow path is connected to a lower side of the bag accommodation space.

10. A cleaner station comprising:

a housing, the housing comprising a coupling part that defines a coupling surface configured to couple to at least a part of a cleaner;

a dust collecting part accommodated in the housing and disposed at a lower side of the coupling part, the dust collecting part being configured to collect dust from a dust bin of the cleaner;

a dust collecting motor accommodated in the housing and disposed below the dust collecting part, the dust collecting motor being configured to generate a suction force for suctioning the dust from the dust bin; and a plurality of flow paths comprising (i) a first flow path configured to connect the dust bin of the cleaner and the dust collecting part and (ii) a second flow path configured to guide air having passed through the dust collecting part to the dust collecting motor, wherein the dust collecting part comprises:

a dust separating part comprising a least one cyclone that is disposed at the lower side of the coupling part and configured to separate dust from the air from the dust bin, a dust bag cartridge disposed below the dust separating part and configured to provide a dust bag, the dust bag being configured to store the dust separated by the dust separating part, a bag support disposed below the dust bag cartridge and configured to accommodate the dust bag, and a joining device disposed below the dust bag cartridge and configured to couple the dust bag to the bag support.

* * * * *